US012117221B2

(12) United States Patent
Newel et al.

(10) Patent No.: US 12,117,221 B2
(45) Date of Patent: Oct. 15, 2024

(54) COOLING SYSTEM WITH A DISTRIBUTION SYSTEM AND A COOLING UNIT

(71) Applicant: Hill Phoenix, Inc., Conyers, GA (US)

(72) Inventors: Jeffrey E. Newel, Snellville, GA (US); Neil John Rathje, South Chesterfield, VA (US); Timothy Dean Swofford, Midlothian, VA (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 18/355,741

(22) Filed: Jul. 20, 2023

(65) Prior Publication Data

US 2023/0358445 A1 Nov. 9, 2023

Related U.S. Application Data

(63) Continuation of application No. 17/640,117, filed as application No. PCT/US2021/038711 on Jun. 23, 2021, now Pat. No. 11,739,989.

(Continued)

(51) Int. Cl.
*F25B 49/02* (2006.01)
*F25B 7/00* (2006.01)

(52) U.S. Cl.
CPC ..... *F25B 7/00* (2013.01); *F25B 49/02* (2013.01); *F25B 2400/16* (2013.01); *F25B 2600/0261* (2013.01); *F25B 2600/2507* (2013.01)

(58) Field of Classification Search
CPC ..... F25B 7/00; F25B 49/02; F25B 2400/16; F25B 2600/0261; F25B 2600/2507;
(Continued)

(56) References Cited

U.S. PATENT DOCUMENTS 3,427,819 A 2/1969 Seghetti
4,548,262 A 10/1985 Hull
(Continued)

FOREIGN PATENT DOCUMENTS

EP 3475576 5/2019
GB 2480861 12/2011
(Continued)

OTHER PUBLICATIONS

International Preliminary Report on Patentability in International Appln. No. PCT/US2021/038711, dated Jan. 5, 2023, 11 pages.
(Continued)

*Primary Examiner* — Miguel A Diaz
(74) *Attorney, Agent, or Firm* — Fish & Richardson P.C.

(57) ABSTRACT

A cooling system includes a distribution system and a cooling unit. The distribution system is configured to circulate a distribution system refrigerant. The distribution system includes a distribution system pump, a main cooler, a distribution system input conduit, and a distribution system output conduit. The main cooler is configured to receive the distribution system refrigerant from the distribution system pump. The distribution system input conduit is configured to receive the distribution system refrigerant from the main cooler. The distribution system output conduit is configured to receive the distribution system refrigerant from the distribution system input conduit and to provide the distribution system refrigerant to the distribution system pump. The cooling unit is configured to circulate a cooling unit refrigerant. The cooling unit includes a cooling unit pump, an upstream receiver, a condenser, a downstream receiver, and an evaporator. The upstream receiver is configured to receive the cooling unit refrigerant.

34 Claims, 8 Drawing Sheets

Related U.S. Application Data

(60) Provisional application No. 63/042,621, filed on Jun. 23, 2020.

(58) Field of Classification Search
CPC ..... F25B 2600/2515; F25B 2600/2501; F25B 2600/25; F25B 41/20; F25B 41/30; F25B 41/31; F25B 41/39
See application file for complete search history.

(56) References Cited

U.S. PATENT DOCUMENTS

| | | | |
|---|---|---|---|
| 4,662,902 | A | 5/1987 | Meyer-Pittroff |
| 5,056,593 | A | 10/1991 | Hull |
| 5,228,301 | A | 7/1993 | Sjoholm et al. |
| 5,309,726 | A | 5/1994 | Asbridge |
| 7,150,412 | B2 | 12/2006 | Wang et al. |
| 7,310,958 | B2 | 12/2007 | Carter et al. |
| 8,033,485 | B2 | 10/2011 | Yamaguchi |
| RE43,121 | E | 1/2012 | Peterson |
| 8,757,522 | B2 | 6/2014 | Tsuji et al. |
| 8,991,203 | B2 | 3/2015 | Okabe et al. |
| 9,546,804 | B2 | 1/2017 | Troutman et al. |
| 10,132,577 | B2 | 11/2018 | Martell et al. |
| 10,151,518 | B2 | 12/2018 | Choueifati et al. |
| 10,393,420 | B2 | 8/2019 | Choueifati et al. |
| 11,067,315 | B2 | 7/2021 | Yamawaki et al. |
| 11,287,165 | B2 | 3/2022 | Bittner |
| 11,739,989 | B2 | 8/2023 | Newel et al. |
| 2005/0000683 | A1 | 1/2005 | Hall et al. |
| 2006/0162354 | A1 | 7/2006 | Jensen |
| 2008/0115921 | A1 | 5/2008 | Hall et al. |
| 2009/0266516 | A1 | 10/2009 | Jewell-Larsen et al. |
| 2010/0162737 | A1 | 7/2010 | Hall et al. |
| 2012/0180508 | A1 | 7/2012 | Endoh et al. |
| 2013/0264048 | A1 | 10/2013 | Matracea et al. |
| 2014/0013790 | A1 | 1/2014 | Asari et al. |
| 2016/0252313 | A1 | 9/2016 | Ziegltrum |
| 2017/0030619 | A1 | 2/2017 | Kim |
| 2017/0205120 | A1* | 7/2017 | Ali ..... F25B 40/00 |
| 2018/0216851 | A1 | 8/2018 | Christensen et al. |
| 2018/0224174 | A1 | 8/2018 | Hollander et al. |
| 2018/0283814 | A1 | 10/2018 | Najafifard |
| 2018/0372387 | A1 | 12/2018 | Echols |
| 2019/0277551 | A1 | 9/2019 | Picouet |
| 2019/0376728 | A1 | 12/2019 | Hayes et al. |
| 2020/0116396 | A1* | 4/2020 | Ito ..... F25B 1/00 |
| 2020/0300511 | A1 | 9/2020 | Yamawaki et al. |
| 2021/0116151 | A1 | 4/2021 | Yamawaki et al. |
| 2021/0364198 | A1 | 11/2021 | Bittner |
| 2022/0186989 | A1 | 6/2022 | Yamaguchi et al. |
| 2022/0357078 | A1* | 11/2022 | Ladd ..... F25B 1/10 |
| 2022/0381485 | A1 | 12/2022 | Uchida et al. |
| 2023/0034122 | A1 | 2/2023 | Farrar et al. |
| 2023/0118033 | A1 | 4/2023 | Newel et al. |

FOREIGN PATENT DOCUMENTS

| | | |
|---|---|---|
| WO | WO 2015/132951 | 9/2015 |
| WO | WO 2017/082714 | 5/2017 |
| WO | WO 2018/004985 | 1/2018 |

OTHER PUBLICATIONS

International Search Report and Written Opinion in International Appln. No. PCT/US2021/033114, dated Sep. 1, 2021, 11 pages.
International Search Report and Written Opinion in International Appln. No. PCT/US2021/038711, dated Nov. 25, 2021, 18 pages.
Invitation to Pay Additional Fees And, Where Applicable, Protest Fee in International Appln. No. PCT/US2021/038711, dated Oct. 1, 2021, 13 pages.
Maxcharge.com [online], "Electrostatic Spraying Systems, Inc.,—the Technology," 2015, retrieved on May 19, 2020, retrieved from URL <http://maxcharge.com/technology/>, 5 pages.

* cited by examiner

COOLING SYSTEM WITH A DISTRIBUTION SYSTEM AND A COOLING UNIT

CROSS REFERENCE TO RELATED APPLICATIONS

This application is a continuation of U.S. patent application Ser. No. 17/640,117, filed on Mar. 3, 2022, which is a U.S. National Phase application under 35 U.S.C. § 371 of International Patent Application No. PCT/US 2021/038711, filed on Jun. 23, 2021, which claims priority under 35 U.S.C. § 119(e) to U.S. Patent Application Ser. No. 63/042,621, filed on Jun. 23, 2020, the entire contents of each of which are hereby incorporated by reference.

TECHNICAL FIELD

The present application relates generally to a cooling system with a distribution system and a cooling unit.

BACKGROUND

Cooling systems circulate a refrigerant and cause that refrigerate to undergo a thermodynamic cycle. The thermodynamic cycle causes a temperature of the refrigerant to change between a maximum temperature and a minimum temperature. Cooling systems transfer heat from a desired space to the refrigerant.

SUMMARY

In one embodiment, a cooling system includes a distribution system and a cooling unit. The distribution system is configured to circulate a distribution system refrigerant. The distribution system includes a distribution system pump, a main cooler, a distribution system input conduit, and a distribution system output conduit. The main cooler is configured to receive the distribution system refrigerant from the distribution system pump. The distribution system input conduit is configured to receive the distribution system refrigerant from the main cooler. The distribution system output conduit is configured to receive the distribution system refrigerant from the distribution system input conduit and to provide the distribution system refrigerant to the distribution system pump. The cooling unit is configured to circulate a cooling unit refrigerant. The cooling unit includes a cooling unit pump, an upstream receiver, a condenser, a downstream receiver, and an evaporator. The upstream receiver is configured to receive the cooling unit refrigerant from the cooling unit pump. The condenser is configured to receive the cooling unit refrigerant from the upstream receiver. The condenser includes cooling unit heat exchange conduit that is configured to be coupled to the distribution system input conduit and the distribution system output conduit. The cooling unit heat exchange conduit is also configured to receive the distribution system refrigerant from the distribution system input conduit. The cooling unit heat exchange conduit is also configured to provide the distribution system refrigerant to the distribution system output conduit. The downstream receiver is configured to receive the cooling unit refrigerant from the condenser. The evaporator is configured to receive the cooling unit refrigerant from the downstream receiver and to provide the cooling unit refrigerant to the cooling unit pump.

In another embodiment, a cooling unit is configured to circulate a cooling unit refrigerant. The cooling unit includes a transfer system upstream control valve, a cooling unit pump, a transfer system conduit, an upstream receiver, a condenser, and an evaporator. The cooling unit pump is configured to receive the cooling unit refrigerant from the transfer system upstream control valve. The transfer system downstream control valve is configured to receive the cooling unit refrigerant from the cooling unit pump. The transfer system conduit is configured to receive the cooling unit refrigerant from the transfer system downstream control valve. The upstream receiver is configured to receive the cooling unit refrigerant from the transfer system downstream control valve. The condenser is configured to receive the cooling unit refrigerant from the upstream receiver. The evaporator is configured to receive the cooling unit refrigerant from the condenser and to provide the cooling unit refrigerant to the transfer system upstream control valve. The transfer system conduit is configured such that the cooling unit refrigerant bypasses the upstream receiver, the condenser, and the evaporator as the cooling unit refrigerant traverses the transfer system conduit between the transfer system upstream control valve and the transfer system downstream control valve.

In yet another embodiment, a cooling unit is configured to circulate a cooling unit refrigerant. The cooling unit includes an expansion system upstream control valve, a cooling unit pump, an expansion system downstream control valve, an expansion tank, a condenser, an evaporator, and a cooling unit controller. The cooling unit pump is configured to receive the cooling unit refrigerant from the expansion system upstream control valve. The expansion system downstream control valve is configured to receive the cooling unit refrigerant from the cooling unit pump. The expansion tank is coupled to the expansion system upstream control valve and the expansion system downstream control valve. The condenser is configured to receive the cooling unit refrigerant from the cooling unit pump. The evaporator is configured to receive the cooling unit refrigerant from the condenser and to provide the cooling unit refrigerant to the expansion system upstream control valve. The cooling unit controller is configured to reposition the expansion system downstream control valve to facilitate routing of the cooling unit refrigerant from the expansion system downstream control valve to the expansion tank while bypassing the condenser and the evaporator.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
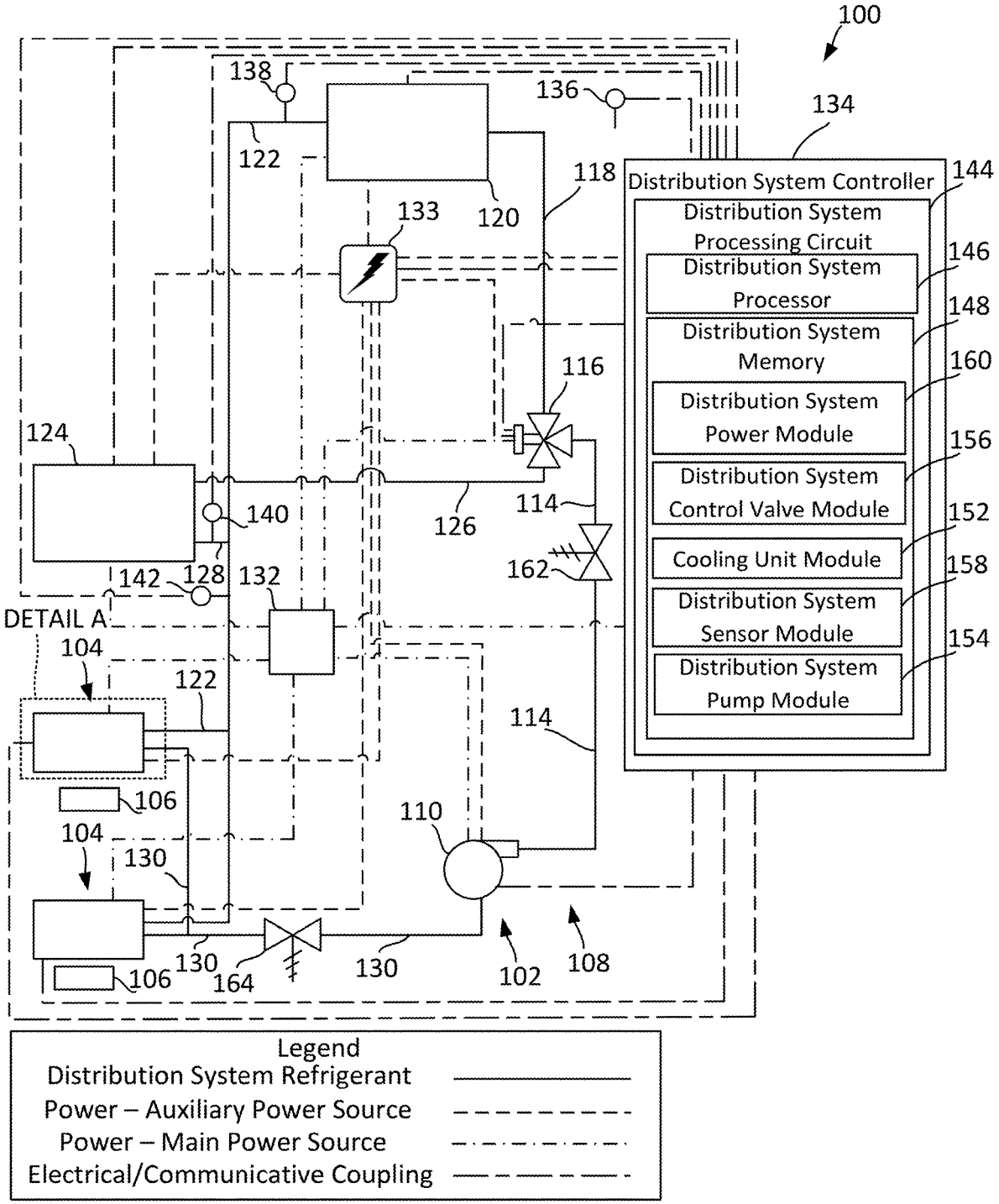
FIG. 1 is a block schematic diagram of an example cooling system.

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and for providing cooling using a cooling system with a distribution system and a cooling unit. The various concepts introduced above and discussed in greater detail below may be implemented in any of a number of ways, as the described concepts are not limited to any particular manner of implementation. Examples of specific implementations and applications are provided primarily for illustrative purposes.

I. Overview

Providing a target, such as a temperature controlled case, with cooling is often performed in order to store products, such as refrigerated goods or frozen goods, in the target. In some applications, multiple targets are each cooled by a local system. For example, where the targets include a number of temperature controlled cases, each temperature controlled case may be cooled by its own local system. The local systems may be cooled by a common cooling system.

In some situations, cooling of these local systems may be inadequate. As a result, refrigerant within these local systems may become pressurized. For example, when power to the local system and/or the common cooling system is lost, a temperature of the refrigerant may increase due to an ambient temperature that is greater than a temperature of the refrigerant. When the pressure of the refrigerant exceeds a threshold, some of the refrigerant may be released. If a certain amount of the refrigerant is released, the local systems must be recharged with refrigerant prior to subsequent use. As a result, there may be significant downtown and/or cost associated with maintaining operation of these local systems.

Implementations described herein are related to a cooling system that includes both a cooling unit, which provides cooling to a target (e.g., display case, freezer case, temperature controlled case, refrigerator, freezer, refrigerated display case, walk-in cooler, temperature controlled locker, etc.), and a distribution system which provides cooling to the cooling unit. The cooling unit and the distribution system each independently circulate a refrigerant. In various embodiments, the cooling unit circulates carbon dioxide. The distribution system may include a main cooler, an auxiliary cooler, and a control valve that routes the refrigerant to the main cooler and/or the auxiliary cooler based upon a source of power for the distribution system.

In some situations, the distribution system is unable to provide cooling to the cooling unit. In these situations, the cooling unit monitors refrigerant parameters and is capable of implementing various actions to mitigate increases of pressure of the refrigerant within the cooling unit without releasing the refrigerant. Through these mitigations, the cooling unit is capable of retaining refrigerant for a longer period of time than other systems. As a result, the cooling unit is more desirable than other systems because the cooling unit described herein does not need to be recharged with refrigerant in a wider variety of situations than other systems that do not include mechanisms for mitigating increases of pressure without releasing refrigerant.

II. Example Cooling System

FIG. 1 depicts an example cooling system 100. The cooling system 100 includes a distribution system 102 (e.g., circulation system, main system, etc.) and one or more cooling units 104 (e.g., local cooling systems, etc.). The distribution system 102 circulates a distribution system refrigerant (e.g., coolant, working fluid, etc.) and the cooling unit 104 circulates a cooling unit refrigerant (e.g., coolant, working fluid, etc.). In various embodiments, the cooling unit refrigerant is carbon dioxide ($CO_2$).

As is explained in more detail herein, the distribution system 102 is configured to provide cooling to each of the cooling units 104 and the cooling units 104 are configured to each provide cooling to a target 106 (e.g., display case, freezer case, temperature controlled case, refrigerator, freezer, refrigerated display case, walk-in cooler, temperature controlled locker, etc.). For example, the cooling units 104 may be incorporated into the targets 106.

Each of the cooling units 104 is configured to operate independent of the other cooling units 104 and of the distribution system 102. In other words, the cooling unit 104 may operate to cool the target 106 associated with the cooling unit 104 despite the distribution system 102 not operating to provide to the cooling unit 104. However, the distribution system 102 is configured to enhance the cooling provided by the cooling units 104 by providing cooling to the cooling units 104. As a result, cooling of the targets 106 is enhanced by the cooperation of the distribution system 102 and the cooling units 104.

The distribution system 102 circulates the distribution system refrigerant within a distribution system conduit system 108 (e.g., plumbing system, piping system, etc.). As is explained in more detail herein, the distribution system conduit system 108 provides the distribution system refrigerant to the cooling units 104 to provide cooling to the cooling units 104. In this way, the distribution system 102 removes the total heat of rejection from each of the cooling units 104.

As is explained in more detail herein, each of the cooling units 104 includes a closed loop system for circulating a refrigerant separate from the distribution system refrigerant. Other systems include release valves that release refrigerant when threshold pressures are exceeded. For example, when power is lost to one of these systems, cooling of the refrigerant typically ceases. This causes the refrigerant to gradually warm, thereby causing a pressure of the refrigerant to gradually increase. If the loss of power occurs for a prolonged period of time, the pressure of the refrigerant eventually exceeds the threshold pressure and a release of the refrigerant occurs. After this release occurs, these systems need to be recharged (e.g., replenished, etc.) with refrigerant prior to use. Recharging results in significant delays and downtime which can be costly and inconvenient for users of these systems. The distribution system 102 and the cooling units 104 are configured to cooperate to maintain refrigerant within the cooling units 104 for a prolonged period of time during loss of power events. In addition, the distribution system 102 is configured to provide desirable cooling to the cooling units 104 at times other than during loss of power events. For example, when ambient conditions make cooling challenging, the distribution system 102 can provide additional cooling to the cooling units 104, thereby preventing an increase in pressure of the refrigerant within the cooling units 104 that would occur in other systems because of the ambient conditions. In these ways, the cooling units 104 may be more desirable than other systems.

The distribution system 102 includes a distribution system pump 110 (e.g., positive-displacement pump, positive-displacement compressor, rotary pump, compressor, rotary compressor, etc.). The distribution system pump 110 is coupled to (e.g., attached to, in fluid communication with, secured to, connected to, fluidly coupled to, etc.) a distribution system first conduit 112 of the distribution system conduit system 108. The distribution system pump 110 receives the distribution system refrigerant from the distribution system first conduit 112. The distribution system pump 110 is also coupled to a distribution system second conduit 114 of the distribution system conduit system 108. The distribution system pump 110 is configured to provide the distribution system refrigerant to the distribution system second conduit 114.

In various embodiments, the distribution system 102 also includes a distribution system control valve 116 (e.g., three-way valve, ball valve, solenoid valve, etc.). The distribution system control valve 116 is coupled to the distribution system second conduit 114 and configured to receive the distribution system refrigerant from the distribution system second conduit 114. The distribution system control valve 116 is also coupled to a distribution system third conduit 118 of the distribution system conduit system 108.

The distribution system 102 also includes a main cooler 120 (e.g., heat exchanger, cooling tower, chiller, cooler, etc.). The main cooler 120 is coupled to the distribution system third conduit 118 and is configured to receive the distribution system refrigerant from the distribution system third conduit 118. The main cooler 120 is configured to cool (e.g., reduce a temperature of, condense, etc.) the distribution system refrigerant. The main cooler 120 is also coupled to a distribution system input conduit 122 of the distribution system conduit system 108. The distribution system input conduit 122 is configured to receive the distribution system refrigerant from the main cooler 120.

In operation, the distribution system refrigerant has a first temperature in the distribution system third conduit 118 (e.g., upstream of the main cooler 120) and a second temperature within the distribution system input conduit 122 (e.g., downstream of the main cooler 120) and the second temperature is less than the first temperature. A difference between the second temperature and the first temperature may be related to a configuration of the main cooler 120 and/or ambient conditions (e.g., temperature, humidity, etc.) surrounding the main cooler 120.

In embodiments where the distribution system 102 includes the distribution system control valve 116, the distribution system also includes an auxiliary cooler 124 (e.g., heat exchanger, cooling tower, chiller, condenser, etc.). As is explained in more detail herein, the auxiliary cooler 124 is configured to cool the distribution system refrigerant separate from the main cooler 120. The auxiliary cooler 124 is capable of providing greater cooling to the distribution system refrigerant than the main cooler 120. As such, the auxiliary cooler 124 may be utilized instead of, or in addition to, the main cooler 120 when the main cooler 120 is unable to desirably cool the distribution system refrigerant.

The distribution system conduit system 108 also includes a first auxiliary conduit 126. The first auxiliary conduit 126 is coupled to the distribution system control valve 116 and configured to receive the distribution system refrigerant from the distribution system control valve 116. The first auxiliary conduit 126 is also coupled to the auxiliary cooler 124 and configured to provide the distribution system refrigerant to the auxiliary cooler 124.

The distribution system control valve 116 is operable between a first position, where the distribution system third conduit 118 is configured to receive the distribution system refrigerant from the distribution system second conduit 114 through the distribution system control valve 116, a second position, where the first auxiliary conduit 126 is configured to receive the distribution system refrigerant from the distribution system second conduit 114 through the distribution system control valve 116, and a third position, where: (i) the distribution system third conduit 118 is configured to receive the distribution system refrigerant from the distribution system second conduit 114 through the distribution system control valve 116 and (ii) the first auxiliary conduit 126 is configured to receive the distribution system refrigerant from the distribution system second conduit 114 through the distribution system control valve 116. In this way, the distribution system control valve 116 may control: (i) when the distribution system refrigerant is provided to the main cooler 120 and the auxiliary cooler 124 and (ii) how much of the distribution system refrigerant is provided to the main cooler 120 and the auxiliary cooler 124. In some embodiments, the distribution system control valve 116 is additionally operable in a fourth position in which the distribution system second conduit 114 is isolated from the distribution system third conduit 118 and the first auxiliary conduit 126. As a result, the main cooler 120 does not receive the distribution system refrigerant from the distribution system control valve 116. Additionally, the auxiliary cooler 124 does not receive the distribution system refrigerant from the distribution system control valve 116.

The distribution system conduit system 108 also includes a second auxiliary conduit 128. The second auxiliary conduit 128 is coupled to the auxiliary cooler 124 and is configured to receive the distribution system refrigerant from the auxiliary cooler 124. The auxiliary cooler 124 is configured to cool (e.g., reduce a temperature of, condense, etc.) the distribution system refrigerant independent of the main cooler 120. In operation, the distribution system refrigerant has a first temperature in the first auxiliary conduit 126 (e.g., upstream of the auxiliary cooler 124) and a second temperature within the second auxiliary conduit 128 (e.g., downstream of the auxiliary cooler 124) and the second temperature is less than the first temperature. A difference between the second temperature and the first temperature may be related to a configuration of the auxiliary cooler 124 and/or ambient conditions (e.g., temperature, humidity, etc.) surrounding the auxiliary cooler 124.

The second auxiliary conduit 128 is also coupled to the distribution system input conduit 122 and configured to provide the distribution system refrigerant to the distribution system input conduit 122. In some embodiments, the distribution system includes a check valve (e.g., one-way valve, etc.) disposed along the second auxiliary conduit 128 to prohibit backflow of the distribution system refrigerant into the second auxiliary conduit 128. Such a check valve may be useful when the distribution system control valve 116 is positioned so as to prohibit flow of the distribution system refrigerant to the first auxiliary conduit 126.

The distribution system input conduit 122 is also coupled to each of the cooling units 104 and configured to provide the distribution system refrigerant to each of the cooling units 104. The distribution system conduit system 108 also includes a distribution system output conduit 130. The distribution system output conduit 130 is coupled to each of the cooling units 104 and configured to receive the distribution system refrigerant from each of the cooling units 104. The distribution system output conduit 130 is also coupled to the distribution system pump 110 and configured to provide the distribution system refrigerant to the distribution system pump 110.

The distribution system 102 is configured to receive power (e.g., electricity, electrical power, etc.) from a main power source 132 (e.g., power grid, etc.). The main power source 132 is electrically coupled to, and configured to provide power to, the cooling units 104, the distribution system pump 110, and the distribution system control valve 116. In some embodiments, the main power source 132 is additionally electrically coupled to, and configured to provide power to, the main cooler 120. For example, the main cooler 120 may include a controller, valves, fans, or other systems that could utilize the power from the main power source 132. Similarly, in some embodiments, the main power source 132 is additionally electrically coupled to, and configured to provide power to, the auxiliary cooler 124. For example, the auxiliary cooler 124 may include a controller, valves, fans, or other systems that could utilize the power from the main power source 132.

In addition to the main power source 132, the distribution system 102 is also configured to receive power from an auxiliary power source 133 (e.g., generator, battery bank, capacitor, etc.). As is explained in more detail herein, the auxiliary power source 133 is configured to function as a substitute for the main power source 132 in the event of a failure or temporary unavailability (e.g., due to a power outage, etc.) of the main power source 132. The auxiliary power source 133 is electrically coupled to, and configured to provide power to, the cooling units 104, the distribution system pump 110, and the distribution system control valve 116. In some embodiments, the auxiliary power source 133 is additionally electrically coupled to, and configured to provide power to, the main cooler 120. For example, the main cooler 120 may include a controller, valves, fans, or other systems that could utilize the power from the auxiliary power source 133. Similarly, in some embodiments, the auxiliary power source 133 is additionally electrically coupled to, and configured to provide power to, the auxiliary cooler 124. For example, the auxiliary cooler 124 may include a controller, valves, fans, or other systems that could utilize the power from the auxiliary power source 133.

The distribution system 102 also includes a distribution system controller 134. The cooling units 104, the distribution system pump 110, the distribution system control valve 116, the main power source 132, and the auxiliary power source 133 are electrically coupled and/or communicatively coupled to the distribution system controller 134. With regard to the main power source 132 and the auxiliary power source 133, the distribution system controller 134 is configured to receive power from the main power source 132 and/or the auxiliary power source 133. Additionally, the distribution system controller 134 may include a battery that is configured to provide power to the distribution system controller 134 during a period of time between when the main power source 132 ceases to provide power to the distribution system controller 134 and when the auxiliary power source 133 provides power to the distribution system controller 134 (e.g., thereby accounting for a starting time associated with the auxiliary power source 133, etc.).

In some embodiments, the main cooler 120 is additionally electrically coupled to and/or communicatively coupled to the distribution system controller 134. For example, the main cooler 120 may include a controller, valves, fans, or other systems that could be controlled by the distribution system controller 134. Similarly, the auxiliary cooler 124 may be electrically coupled and/or communicatively coupled to the distribution system controller 134. For example, the auxiliary cooler 124 may include a controller, valves, fans, or other systems that could be controlled by the distribution system controller 134.

Various sensors (e.g., temperature sensors, flow rate sensors, quality sensors, pressure sensors, etc.) may additionally be electrically coupled and/or communicatively coupled to the distribution system controller 134. These various sensors may be capable of determining refrigerant parameters (e.g., temperature, flow rate, quality, pressure, volumetric flow rate, mass flow rate, etc.) of the distribution system refrigerant and/or the second circuit refrigerant.

The distribution system 102 includes an ambient sensor 136. The ambient sensor 136 is configured to measure an ambient parameter (e.g., temperature, pressure, quality, etc.) associated with an ambient environment surrounding the distribution system 102. For example, the ambient sensor 136 may measure an ambient temperature. The ambient sensor 136 is electrically coupled and/or communicatively coupled to the distribution system controller 134. As a result, the distribution system controller 134 is configured to receive the ambient parameter from the ambient sensor 136.

The distribution system 102 includes a main cooler sensor 138. The main cooler sensor 138 is configured to measure a refrigerant parameter of the distribution system refrigerant within the distribution system input conduit 122 upstream of the auxiliary cooler 124 and the cooling units 104. For example, the main cooler sensor 138 may measure a temperature of the distribution system refrigerant within the distribution system input conduit 122 upstream of the auxiliary cooler 124 and the cooling units 104. The main cooler sensor 138 is electrically coupled and/or communicatively coupled to the distribution system controller 134. As a result, the distribution system controller 134 is configured to receive the refrigerant parameter from the main cooler sensor 138.

The distribution system 102 includes an auxiliary sensor 140. The auxiliary sensor 140 is configured to measure a refrigerant parameter of the distribution system refrigerant within the second auxiliary conduit 128 upstream of the distribution system input conduit 122. For example, the auxiliary sensor 140 may measure a temperature of the distribution system refrigerant within the second auxiliary conduit 128 upstream of the distribution system input conduit 122. The auxiliary sensor 140 is electrically coupled and/or communicatively coupled to the distribution system controller 134. As a result, the distribution system controller 134 is configured to receive the refrigerant parameter from the auxiliary sensor 140.

The distribution system 102 includes a delivery sensor 142. The delivery sensor 142 is configured to measure a refrigerant parameter of the distribution system refrigerant within the distribution system input conduit 122 downstream of the auxiliary cooler 124 and upstream of the cooling units 104. For example, the delivery sensor 142 may measure a temperature of the distribution system refrigerant within the distribution system input conduit 122 downstream of the auxiliary cooler 124 and upstream of the cooling units 104. The delivery sensor 142 is electrically coupled and/or communicatively coupled to the distribution system controller 134. As a result, the distribution system controller 134 is configured to receive the refrigerant parameter from the delivery sensor 142.

The distribution system controller 134 includes a distribution system processing circuit 144. The distribution system processing circuit 144 includes a distribution system processor 146 and a distribution system memory 148. The distribution system processor 146 may include a microprocessor, an application-specific integrated circuit (ASIC), a field-programmable gate array (FPGA), other similar components, or combinations thereof. The distribution system memory 148 may include, but is not limited to, electronic, optical, magnetic, or any other storage or transmission device capable of providing a processor, ASIC, FPGA, or other similar components, with program instructions. The distribution system memory 148 may include a memory chip, Electrically Erasable Programmable Read-Only Memory (EEPROM), Erasable Programmable Read Only Memory (EPROM), flash memory, or any other suitable memory from which the distribution system controller 134 can read instructions. The instructions may include code from any suitable programming language.

The distribution system memory 148 may include various modules that include instructions which are configured to be implemented by the distribution system processor 146. The distribution system memory 148 includes a cooling unit module 152. The cooling unit module 152 includes instructions which are configured to be implemented by the distribution system processor 146 to control operation of the cooling units 104. The distribution system memory 148 includes a distribution system pump module 154. The distribution system pump module 154 includes instructions which are configured to be implemented by the distribution system processor 146 to control operation of the distribution system pump 110. The distribution system memory 148 includes a distribution system control valve module 156. The distribution system control valve module 156 includes instructions which are configured to be implemented by the distribution system processor 146 to control operation of the distribution system control valve 116. The distribution system memory 148 includes a distribution system sensor module 158. The distribution system sensor module 158 includes instructions which are configured to be implemented by the distribution system processor 146 to receive communications (e.g., refrigerant parameters, ambient parameters, etc.) from the ambient sensor 136, the main cooler sensor 138, the auxiliary sensor 140, and the delivery sensor 142. The distribution system memory 148 includes a distribution system power module 160. The distribution system power module 160 includes instructions which are configured to be implemented by the distribution system processor 146 to receive communications from the main power source 132 and the auxiliary power source 133 and to control operation of the auxiliary power source 133.

As is explained in more detail herein, the distribution system controller 134 is configured to control operation of the cooling units 104 (e.g., based on the instructions stored in the cooling unit module 152, etc.). For example, the distribution system controller 134 may control operation of components (e.g., pumps, etc.) of the cooling units 104 based on an ambient parameter measured by the ambient sensor 136 and/or a refrigerant parameter measured by the main cooler sensor 138, the auxiliary sensor 140, and/or the delivery sensor 142. Additionally, the distribution system controller 134 may control operation of the cooling units 104 based on whether power is provided by the main power source 132 or the auxiliary power source 133.

The distribution system controller 134 is configured to control operation of the distribution system pump 110 (e.g., based on the instructions stored in the distribution system pump module 154, etc.). For example, the distribution system controller 134 may control an operating parameter (e.g., voltage supplied to the distribution system pump 110, current supplied to the distribution system pump 110, etc.) of the distribution system pump 110 in order to achieve a target refrigerant parameter of the distribution system refrigerant within the distribution system conduit system 108. Additionally, the distribution system controller 134 may control operation of the distribution system pump 110 based on whether power is provided by the main power source 132 or the auxiliary power source 133.

The distribution system controller 134 is configured to control operation of the distribution system control valve 116 (e.g., based on the instructions stored in the distribution system control valve module 156, etc.). For example, the distribution system controller 134 may selectively reposition (e.g., from the first position to the second position, from the first position to the third position, from the second position to the first position, from the second position to the third position, from the third position to the first position, from the third position to the second position, etc.) the distribution system control valve 116. Additionally, the distribution system controller 134 may control operation of the distribution system control valve 116 based on whether power is provided by the main power source 132 or the auxiliary power source 133.

The distribution system controller 134 is configured to facilitate interactions with the ambient sensor 136, the main cooler sensor 138, the auxiliary sensor 140, and the delivery sensor 142 (e.g., based on the instructions stored in the distribution system sensor module 158, etc.). For example, the distribution system controller 134 may periodically (e.g., once an hour, etc.) utilize the ambient parameter provided by the ambient sensor 136 while continuously (e.g., once a minute, etc.) utilizing the refrigerant parameter provided by the delivery sensor 142. Additionally, the distribution system controller 134 may facilitate interactions with the ambient sensor 136, the main cooler sensor 138, the auxiliary sensor 140, and the delivery sensor 142 based on whether power is provided by the main power source 132 or the auxiliary power source 133.

The distribution system controller 134 is configured to control operation of the auxiliary power source 133 (e.g., based on the instructions stored in the distribution system power module 160, etc.). For example, the distribution system controller 134 may cause the auxiliary power source 133 to be turned on in response to determining that the main power source 132 has failed and/or is unavailable.

In some embodiments, the distribution system 102 includes a distribution system high pressure relief valve (PRV) 162 (e.g., blow-off valve, etc.) disposed along the distribution system second conduit 114. The distribution system high PRV 162 is configured to open when a pressure of the distribution system refrigerant within the distribution system second conduit 114 exceeds a high pressure threshold. In this way, the distribution system high PRV 162 may protect the distribution system 102 from impacts of the over-pressurized distribution system refrigerant. In various embodiments, the high pressure threshold is approximately equal to (e.g., within 5% of, etc.) between 50 bar and 75 bar, inclusive (e.g., 48 bar, 50 bar, 55 bar, 65 bar, 75 bar, 77 bar, etc.).

In some embodiments, the distribution system 102 includes a distribution system low PRV 164 (e.g., blow-off valve, etc.) disposed along the distribution system output conduit 130. The distribution system low PRV 164 is configured to open when a pressure of the distribution system refrigerant within the distribution system output conduit 130 exceeds a low pressure threshold. In this way, the distribution system low PRV 164 may protect the distribution system 102 from impacts of the over-pressurized distribution system refrigerant. In embodiments where the distribution system 102 includes both the distribution system high PRV 162 and the distribution system low PRV 164, the high pressure threshold is greater than the low pressure threshold. In various embodiments, the low pressure threshold is approximately equal to (e.g., within 5% of, etc.) between 35 bar and 50 bar, inclusive (e.g., 33 bar, 35 bar, 40 bar, 45 bar, 50 bar, 52 bar, etc.).

In some embodiments, the main cooler 120 is configured such that the auxiliary cooler 124 is not required and thus is not included in the distribution system 102. For example, where the main cooler 120 is a chiller rather than a condenser, the main cooler 120 may be capable of operating independent of the auxiliary cooler 124. As such, the auxiliary cooler 124, the first auxiliary conduit 126, the second auxiliary conduit 128, and the auxiliary sensor 140 are not included in the distribution system 102 in some embodiments.

In various embodiments, the main cooler 120 is replaced with a water loop (e.g., from a facility) flowing through a heat exchanger. Such embodiments may be advantageous in applications where the cooling system is installed in a facility having a relatively high volume water loop (e.g., because cooling provided by this water loop can be harnessed, etc.) or in applications where space constraints make installation of an additional structure, such as a condenser, difficult.

While the cooling system 100 is shown in FIG. 1 as including two cooling units 104, it is understood that the cooling system 100 may include one, three, four, six, ten, or other numbers of the cooling units 104. Similarly, it is understood that the cooling system 100 may operate without any cooling units 104, such as when cooling units 104 are removed and new cooling units 104 are being installed.

III. First Example Operation of the Cooling System with an Auxiliary Cooler

Figure 2:
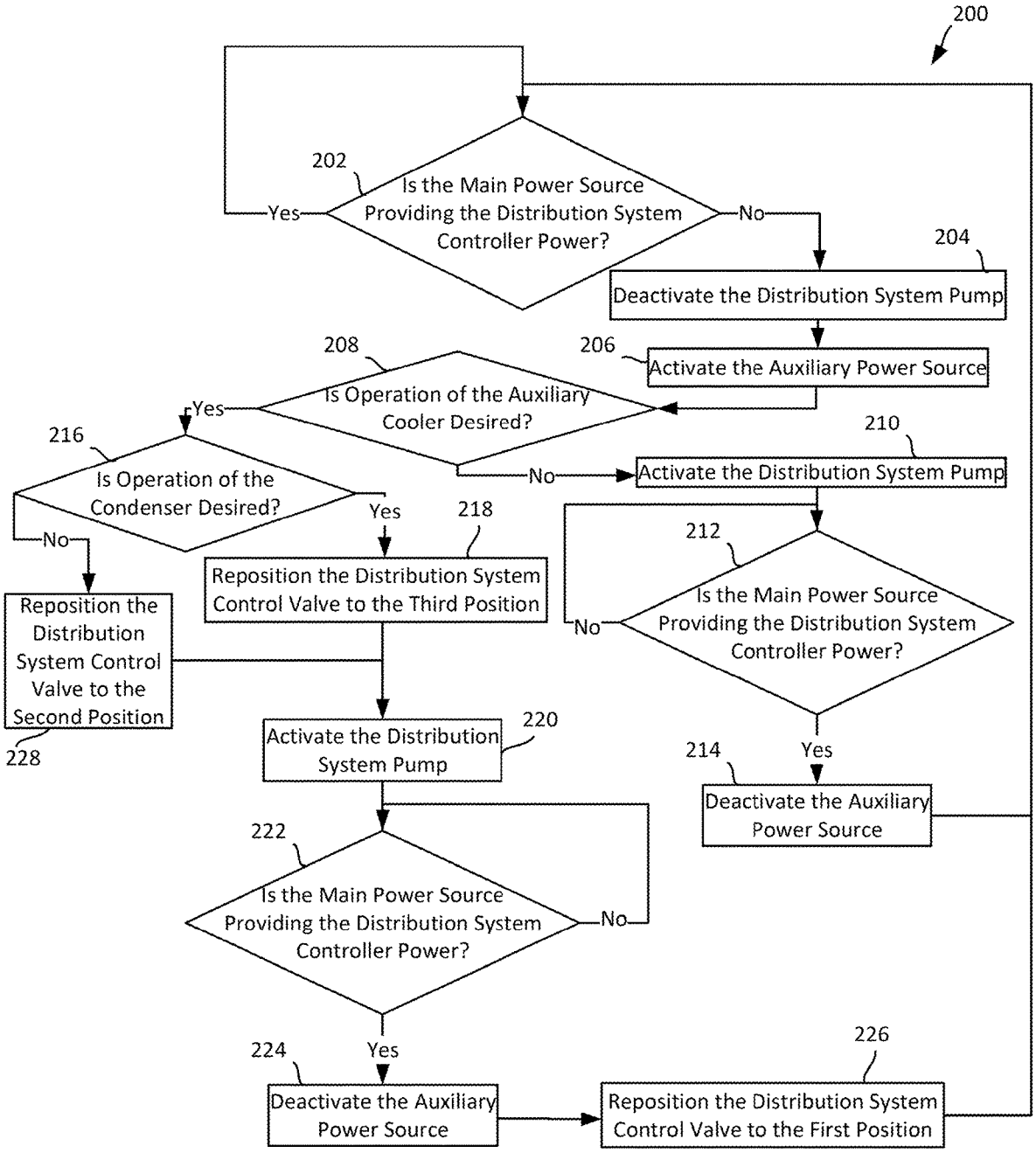
FIG. 2 is a block diagram of an example method of utilizing a distribution system to remove heat from a cooling unit.

As shown in FIG. 2, a method 200 of utilizing the distribution system 102 to remove heat from the cooling unit 104 is shown. In the method 200, the distribution system 102 includes the auxiliary cooler 124, the first auxiliary conduit 126, the second auxiliary conduit 128, and the auxiliary sensor 140. While the distribution system controller 134 is receiving power from the main power source 132, the distribution system control valve 116 is in the first position (e.g., where the distribution system third conduit 118 is configured to receive the distribution system refrigerant from the distribution system second conduit 114 through the distribution system control valve 116).

The method 200 begins in block 202 with determining, by the distribution system controller 134 (e.g., via the distribution system power module 160, etc.), if the main power source 132 is providing the distribution system controller 134 with power. For example, the distribution system controller 134 may monitor a current and/or voltage provided by the main power source 132 and determine that the main power source 132 is not providing the distribution system controller 134 power when the current and/or voltage drops below a threshold (e.g., a minimum current, a minimum voltage, etc.). If the distribution system controller 134 determines that the main power source 132 is providing the distribution system controller 134 with power, the method 200 restarts (e.g., ends and continues to block 202 again, etc.).

If the distribution system controller 134 determines that the main power source 132 is not providing the distribution system controller 134 with power, the method 200 continues in block 204 with deactivating (e.g., via the distribution system pump module 154, etc.), by the distribution system controller 134, the distribution system pump 110. For example, the distribution system controller 134 may provide a signal to the distribution system pump 110 to turn off the distribution system pump 110.

The method 200 continues in block 206 with activating (e.g., via the distribution system power module 160, etc.), by the distribution system controller 134, the auxiliary power source 133. For example, the distribution system controller 134 may send a signal to the auxiliary power source 133 to instruct the auxiliary power source 133 to turn on. As a result of activating the auxiliary power source 133, auxiliary power may be provided to the cooling units 104, the distribution system pump 110, the distribution system control valve 116, and the auxiliary cooler 124, for example.

The method 200 continues in block 208 with determining (e.g., via the distribution system sensor module 158, etc.), by the distribution system controller 134, if operation of the auxiliary cooler 124 is desired. This determination is based on whether operation of the main cooler 120 alone is sufficient to maintain a temperature of the distribution system refrigerant below a threshold temperature associated with opening of the distribution system high PRV 162 and/or opening of the distribution system low PRV 164. The distribution system controller 134 makes this determination by comparing (e.g., via the distribution system sensor module 158, etc.), by the distribution system controller 134, at least one measured parameter (e.g., the ambient parameter from the ambient sensor 136, the refrigerant parameter of the distribution system refrigerant measured by the main cooler sensor 138, the refrigerant parameter of the distribution system refrigerant measured by the auxiliary sensor 140, the refrigerant parameter of the distribution system refrigerant measured by the delivery sensor 142, etc.) to a threshold parameter (e.g., stored in the distribution system sensor module 158, etc.) associated with the measured parameter and the threshold temperature. For example, the distribution system sensor module 158 may store a threshold temperature of 42 degrees Fahrenheit (° F.) associated with the delivery sensor 142 (e.g., in a situation where it is desired to maintain a temperature of the distribution system refrigerant below 42° F. at the location of the delivery sensor 142, etc.) and the distribution system controller 134 may obtain a measured temperature from the delivery sensor 142. In this example, if the measured temperature is greater than 42° F., then the distribution system controller 134 determines that operation of the auxiliary cooler 124 is desired.

If in block 208 the distribution system controller 134 determines that operation of the auxiliary cooler 124 is not desired, then the method 200 continues in block 210 with activating (e.g., via the distribution system pump module 154, etc.), by the distribution system controller 134, the distribution system pump 110. For example, the distribution system controller 134 may provide a signal to the distribution system pump 110 to turn on the distribution system pump 110. After the distribution system pump 110 has been activated, the distribution system refrigerant may be cooled by the main cooler 120 and subsequently provided to the cooling units 104.

The method 200 continues in block 212 with determining, by the distribution system controller 134 (e.g., via the distribution system power module 160, etc.), if the main power source 132 is providing the distribution system controller 134 with power. For example, the distribution system controller 134 may monitor a current and/or voltage provided by the main power source 132 and determine that the main power source 132 is providing the distribution system controller 134 power when the current and/or voltage exceeds a threshold (e.g., a minimum current, a minimum voltage, etc.). If the distribution system controller 134 determines that the main power source 132 is not providing the distribution system controller 134 with power, the method 200 continues to block 212 again.

If the distribution system controller determines in block 212 that the main power source 132 is providing the distribution system controller 134 with power, the method 200 continues in block 214 with deactivating (e.g., via the distribution system power module 160, etc.), by the distribution system controller 134, the auxiliary power source 133. For example, the distribution system controller 134 may send a signal to the auxiliary power source 133 to instruct the auxiliary power source 133 to turn off. As a result of deactivating the auxiliary power source 133, auxiliary power may cease to be provided to the cooling units 104, the distribution system pump 110, the distribution system control valve 116, and the auxiliary cooler 124, for example. The method 200 then continues back to block 202.

If in block 208 the distribution system controller 134 determines that operation of the auxiliary cooler 124 is not desired, then the method 200 continues in block 216 with determining (e.g., via the distribution system sensor module 158, etc.), by the distribution system controller 134, if operation of the main cooler 120 is desired. This determination is based on whether operation of the auxiliary cooler 124 alone is sufficient to maintain the temperature of the distribution system refrigerant below the threshold temperature. The distribution system controller 134 makes this determination by comparing (e.g., via the distribution system sensor module 158, etc.), by the distribution system controller 134, at least one measured parameter (e.g., the ambient parameter from the ambient sensor 136, the refrigerant parameter of the distribution system refrigerant measured by the main cooler sensor 138, the refrigerant parameter of the distribution system refrigerant measured by the auxiliary sensor 140, the refrigerant parameter of the distribution system refrigerant measured by the delivery sensor 142, etc.) to a threshold parameter (e.g., stored in the distribution system sensor module 158, etc.) associated with the measured parameter and the threshold temperature.

If in block 216 the distribution system controller 134 determines that operation of the main cooler 120 is desired, then the method 200 continues in block 218 with repositioning (e.g., via the distribution system control valve module 156, etc.), by the distribution system controller 134, the distribution system control valve 116 from the first position to the third position (e.g., where: (i) the distribution system third conduit 118 is configured to receive the distribution system refrigerant from the distribution system second conduit 114 through the distribution system control valve 116 and (ii) the first auxiliary conduit 126 is configured to receive the distribution system refrigerant from the distribution system second conduit 114 through the distribution system control valve 116). For example, the distribution system controller 134 may send a signal to the distribution system control valve 116 to cause rotation of the distribution system control valve 116. As a result of being in the third position, the distribution system refrigerant is cooled by both the main cooler 120 and the auxiliary cooler 124.

The method 200 continues in block 220 with activating (e.g., via the distribution system pump module 154, etc.), by the distribution system controller 134, the distribution system pump 110. For example, the distribution system controller 134 may provide a signal to the distribution system pump 110 to turn on the distribution system pump 110. After the distribution system pump 110 has been activated, the distribution system refrigerant may be cooled by the main cooler 120 and subsequently provided to the cooling units 104 and also may be cooled by the auxiliary cooler 124 and subsequently provided to the cooling units 104.

The method 200 continues in block 222 with determining, by the distribution system controller 134 (e.g., via the distribution system power module 160, etc.), if the main power source 132 is providing the distribution system controller 134 with power. For example, the distribution system controller 134 may monitor a current and/or voltage provided by the main power source 132 and determine that the main power source 132 is providing the distribution system controller 134 power when the current and/or voltage exceeds a threshold (e.g., a minimum current, a minimum voltage, etc.). If the distribution system controller 134 determines that the main power source 132 is not providing the distribution system controller 134 with power, the method 200 continues to block 222 again.

If the distribution system controller determines in block 222 that the main power source 132 is providing the distribution system controller 134 with power, the method 200 continues in block 224 with deactivating (e.g., via the distribution system power module 160, etc.), by the distribution system controller 134, the auxiliary power source 133. For example, the distribution system controller 134 may send a signal to the auxiliary power source 133 to instruct the auxiliary power source 133 to turn off. As a result of deactivating the auxiliary power source 133, auxiliary power may cease to be provided to the cooling units 104, the distribution system pump 110, the distribution system control valve 116, and the auxiliary cooler 124, for example.

The method 200 continues in block 226 with repositioning (e.g., via the distribution system control valve module 156, etc.), by the distribution system controller 134, the distribution system control valve 116 to the first position (e.g., where the distribution system third conduit 118 is configured to receive the distribution system refrigerant from the distribution system second conduit 114 through the distribution system control valve 116). For example, the distribution system controller 134 may send a signal to the distribution system control valve 116 to cause rotation of the distribution system control valve 116 from the third position to the first position. The method 200 then continues back to block 202.

If in block 216 the distribution system controller 134 determines that operation of the main cooler 120 is not desired, then the method 200 continues in block 228 with repositioning (e.g., via the distribution system control valve module 156, etc.), by the distribution system controller 134, the distribution system control valve 116 from the first position to the second position (e.g., where the first auxiliary conduit 126 is configured to receive the distribution system refrigerant from the distribution system second conduit 114 through the distribution system control valve 116). For example, the distribution system controller 134 may send a signal to the distribution system control valve 116 to cause rotation of the distribution system control valve 116. As a result of being in the second position, the distribution system refrigerant is cooled by only the auxiliary cooler 124. The method 200 than contains to block 220.

In embodiments where the distribution system 102 does not include the auxiliary cooler 124, the first auxiliary conduit 126, the second auxiliary conduit 128, and the auxiliary sensor 140, the method 200 does not include block 208, block 216, block 218, block 220, block 222, block 224, block 226, or block 228. As a result, block 206 skips straight to block 210.

IV. Second Example Operation of the Cooling System with an Auxiliary Cooler

Figure 3:
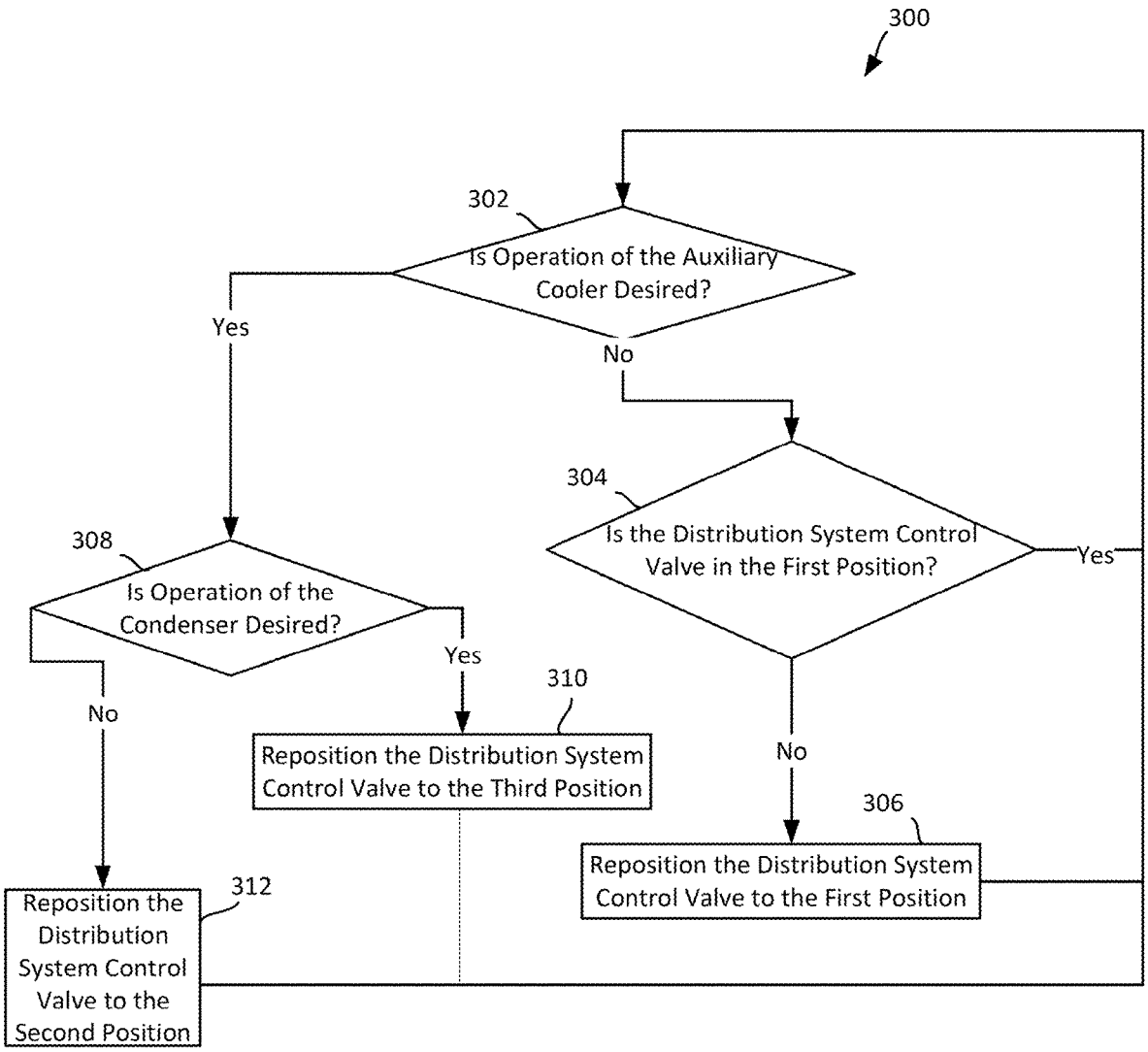
FIG. 3 is a block diagram of another example method of utilizing a distribution system to remove heat from a cooling unit.

As shown in FIG. 3, a method 300 of utilizing the distribution system 102 to remove heat from the cooling unit 104 is shown. In the method 300, the distribution system 102 includes the auxiliary cooler 124, the first auxiliary conduit 126, the second auxiliary conduit 128, and the auxiliary sensor 140. In the method 300, the distribution system controller 134 is receiving power from the main power source 132 and with the distribution system control valve 116 is in the first position (e.g., where the distribution system third conduit 118 is configured to receive the distribution system refrigerant from the distribution system second conduit 114 through the distribution system control valve 116).

The method 300 begins in block 302 with determining (e.g., via the distribution system sensor module 158, etc.), by the distribution system controller 134, if operation of the auxiliary cooler 124 is desired. This determination is based on whether operation of the main cooler 120 alone is sufficient to provide the cooling units 104 with a desired amount of cooling. For example, the distribution system controller 134 may compare a refrigerant parameter measured at the delivery sensor 142 with a target refrigerant parameter associated with the delivery sensor 142. In another example, the distribution system controller 134 may compare an ambient parameter measured by the ambient sensor 136 to a target ambient parameter. For example, when the ambient parameter indicates that the temperature is greater than a threshold associated with desirable cooling of the cooling units 104, the distribution system controller 134 may determine that cooling using the auxiliary cooler 124 is desired.

If in block 302 the distribution system controller 134 determines that operation of the auxiliary cooler 124 is not desired, then the method 300 continues in block 304 with determining (e.g., via the distribution system control valve module 156, etc.), by the distribution system controller 134, if the distribution system control valve 116 is in the first position (e.g., where the distribution system third conduit 118 is configured to receive the distribution system refrigerant from the distribution system second conduit 114 through the distribution system control valve 116). If the distribution system controller 134 determines that the distribution system control valve 116 is in the first position, then the method 300 continues back to block 304.

If the distribution system controller 134 determines that the distribution system control valve 116 is not in the first position (e.g., the distribution system control valve is in the second position, the distribution system control valve is in the third position, etc.), then the method 300 continues in block 306 with repositioning (e.g., via the distribution system control valve module 156, etc.), by the distribution system controller 134, the distribution system control valve 116 to the first position. For example, the distribution system controller 134 may send a signal to the distribution system control valve 116 to cause rotation of the distribution system control valve 116. The method then continues to block 302.

If in block 302, the distribution system controller 134 determines that operation of the auxiliary cooler 124 is desired, the method 300 continues in block 308 with determining (e.g., via the distribution system sensor module 158, etc.), by the distribution system controller 134, if operation of the main cooler 120 is desired. This determination is based on whether operation of the auxiliary cooler 124 alone is sufficient to provide the cooling units 104 with a desired amount of cooling. The distribution system controller 134 makes this determination by comparing (e.g., via the distribution system sensor module 158, etc.), by the distribution system controller 134, at least one measured parameter (e.g., the ambient parameter from the ambient sensor 136, the refrigerant parameter of the distribution system refrigerant measured by the main cooler sensor 138, the refrigerant parameter of the distribution system refrigerant measured by the auxiliary sensor 140, the refrigerant parameter of the distribution system refrigerant measured by the delivery sensor 142, etc.) to a threshold parameter (e.g., stored in the distribution system sensor module 158, etc.) associated with the measured parameter and the threshold temperature.

If in block 308 the distribution system controller 134 determines that operation of the main cooler 120 is desired, then the method 300 continues in block 310 with repositioning (e.g., via the distribution system control valve module 156, etc.), by the distribution system controller 134, the distribution system control valve 116 from the first position to the third position (e.g., where: (i) the distribution system third conduit 118 is configured to receive the distribution system refrigerant from the distribution system second conduit 114 through the distribution system control valve 116 and (ii) the first auxiliary conduit 126 is configured to receive the distribution system refrigerant from the distribution system second conduit 114 through the distribution system control valve 116). For example, the distribution system controller 134 may send a signal to the distribution system control valve 116 to cause rotation of the distribution system control valve 116. As a result of being in the third position, the distribution system refrigerant is cooled by both the main cooler 120 and the auxiliary cooler 124. The method 300 then continues to block 302.

If in block 308 the distribution system controller 134 determines that operation of the main cooler 120 is not desired, then the method 300 continues in block 312 with repositioning (e.g., via the distribution system control valve module 156, etc.), by the distribution system controller 134, the distribution system control valve 116 from the first position to the second position (e.g., where the first auxiliary conduit 126 is configured to receive the distribution system refrigerant from the distribution system second conduit 114 through the distribution system control valve 116). For example, the distribution system controller 134 may send a signal to the distribution system control valve 116 to cause rotation of the distribution system control valve 116. As a result of being in the second position, the distribution system refrigerant is cooled by only the auxiliary cooler 124. The method 300 then continues to block 302.

V. Example Cooling Unit

Figure 4:
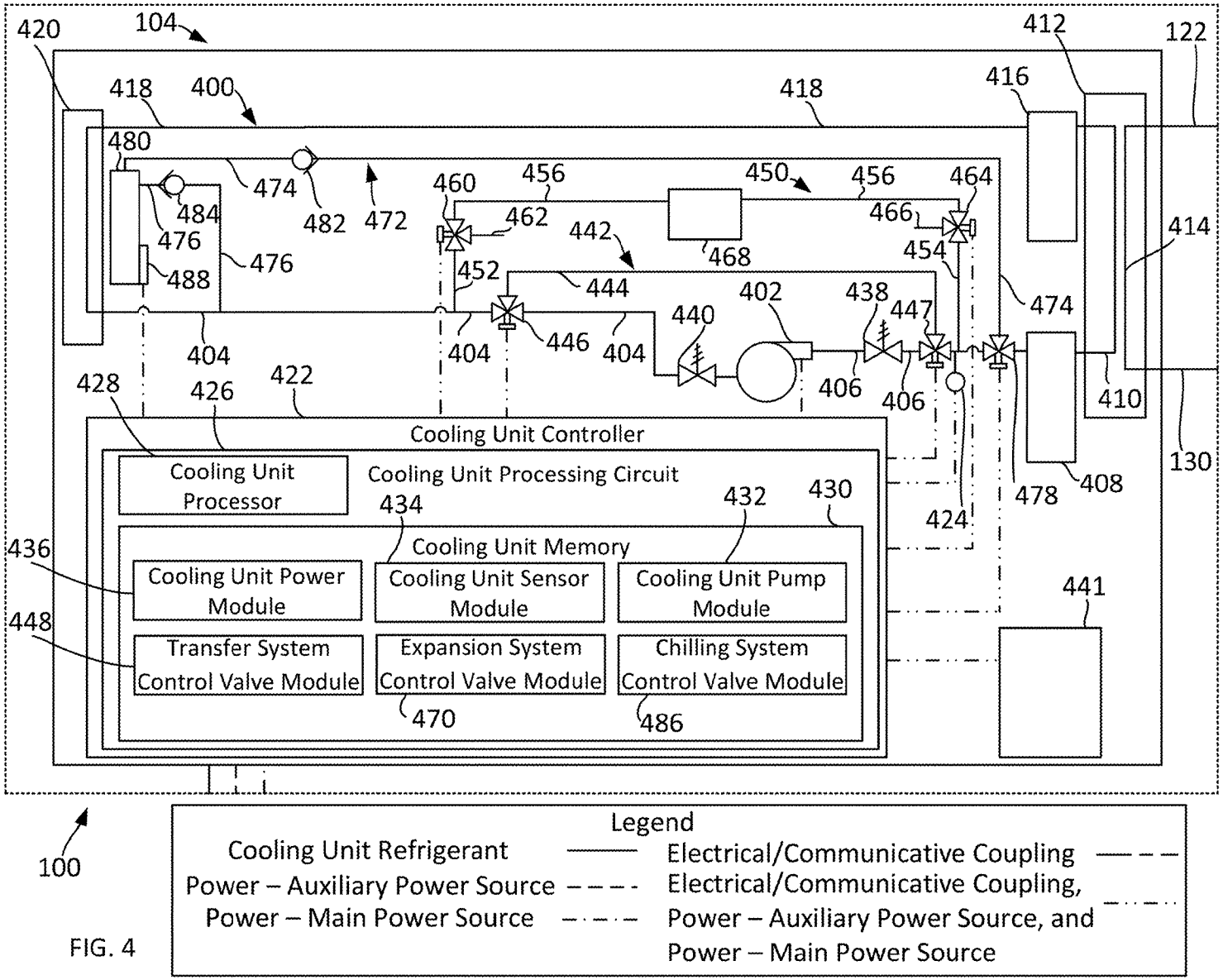
FIG. 4 is a detailed view of an example cooling unit shown in DETAIL A from FIG. 1.

FIG. 4 depicts the cooling unit 104 according to various embodiments. The cooling unit 104 circulates the cooling unit refrigerant within a cooling unit conduit system 400 (e.g., plumbing system, piping system, etc.). In various embodiments, the cooling unit refrigerant is carbon dioxide ($CO_2$). In some embodiments, the cooling unit refrigerant is different from the distribution system refrigerant. For example, the cooling unit refrigerant may be $CO_2$ and the distribution system refrigerant may be a hydro-fluorocarbon (HFC) refrigerant, a hydrofluoroolefin (HFO) refrigerant, or a natural refrigerant (e.g., a water-glycol refrigerant, etc.).

The cooling unit 104 includes a cooling unit pump 402 (e.g., positive-displacement pump, positive-displacement compressor, rotary pump, compressor, rotary compressor, etc.). The cooling unit pump 402 is coupled to (e.g., attached to, in fluid communication with, secured to, connected to, fluidly coupled to, etc.) a cooling unit first conduit 404 of the cooling unit conduit system 400. The cooling unit pump 402 receives the cooling unit refrigerant from the cooling unit first conduit 404. The cooling unit pump 402 is also coupled to a cooling unit second conduit 406 of the cooling unit conduit system 400. The cooling unit pump 402 is configured to provide the cooling unit refrigerant to the cooling unit second conduit 406.

The cooling unit 104 also includes an upstream receiver 408 (e.g., tank, container, etc.). The upstream receiver 408 is coupled to the cooling unit second conduit 406 and configured to receive the cooling unit refrigerant from the cooling unit second conduit 406. The upstream receiver 408 is also coupled to a cooling unit third conduit 410 of the cooling unit conduit system 400. The cooling unit third conduit 410 is configured to receive the cooling unit refrigerant from the upstream receiver 408.

In various embodiments, the upstream receiver 408 is configured such that vapor may flow freely from the upstream receiver 408 into the cooling unit third conduit 410 while liquid is retained within the upstream receiver 408. For example, an outlet of the upstream receiver 408 may located at an uppermost portion of the upstream receiver 408 such that gravity biases liquid away from the outlet, thereby causing the liquid to be retained within the upstream receiver 408. Liquid within the upstream receiver 408 may be heated over time, thus turning into vapor which may flow out of the upstream receiver 408. In some embodiments, the upstream receiver 408 is configured such that a maximum level of liquid permitted within the upstream receiver 408 does not inhibit operation of the cooling unit 104. For example, a height of the outlet within the upstream receiver 408 may be selected such that when a target amount of liquid accumulates within the upstream receiver 408, a portion of the liquid is capable of flowing out of the upstream receiver 408 and into the cooling unit third conduit 410.

The cooling unit 104 also includes a condenser 412 (e.g., heat exchanger, chiller, cooler, etc.). The cooling unit third conduit 410 extends within the condenser 412. Additionally, a cooling unit exchange conduit 414 extends within the condenser 412. The cooling unit exchange conduit 414 is configured to be coupled to the distribution system input conduit 122 and the distribution system output conduit 130. When the cooling unit exchange conduit 414 is coupled to the distribution system input conduit 122 and the distribution system output conduit 130, the cooling unit exchange conduit 414 is configured to receive the distribution system refrigerant from the distribution system input conduit 122 and to provide the distribution system refrigerant to the distribution system output conduit 130. The condenser 412 may be a water-cooled condenser, an air-cooled condenser, or an adiabatic gas cooler of the type described in the Applicant's pending U.S. patent application Ser. No. 16/878,730.

The condenser 412 is configured to cool the cooling unit refrigerant using the cooling provided by the distribution system refrigerant. Specifically, the distribution system 102 is configured such that a temperature of the distribution system refrigerant within the distribution system input conduit 122 is less than a temperature of the cooling unit refrigerant within the cooling unit third conduit 410. The distribution system 102 may control a temperature of the distribution system refrigerant within the distribution system input conduit 122 (e.g., based on a temperature of the cooling unit refrigerant within the cooling unit third conduit 410, etc.) in order to provide a target amount of cooling to the cooling unit 104.

The cooling unit exchange conduit 414 is configured to be selectively coupled to the distribution system input conduit 122 and configured to be selectively coupled to the distribution system output conduit 130. For example, the cooling unit exchange conduit 414 may include a male coupling (e.g., fitting, etc.) that is configured to be coupled to, and decoupled from, a female coupling (e.g., fitting, etc.) of the distribution system input conduit 122 and/or the distribution system output conduit 130. In this way, the cooling unit 104 may be disconnected from the distribution system conduit system 108. By disconnecting the cooling unit 104 from the distribution system conduit system 108, the cooling unit 104 may be replaced, serviced, or used independently of the distribution system conduit system 108 (e.g., because the cooling unit refrigerant is maintained separate from the distribution system refrigerant).

In operation, the cooling unit refrigerant has a first temperature in the cooling unit third conduit 410 (e.g., upstream of the condenser 412) and a second temperature within the cooling unit third conduit 410 (e.g., downstream of the condenser 412) and the second temperature is less than the first temperature. A difference between the second temperature and the first temperature may be related to a configuration of the condenser 412 and/or ambient conditions (e.g., temperature, humidity, etc.) surrounding the condenser 412.

The cooling unit 104 also includes a downstream receiver 416 (e.g., tank, container, etc.). The downstream receiver 416 is coupled to the cooling unit third conduit 410 and configured to receive the cooling unit refrigerant from the cooling unit third conduit 410. The downstream receiver 416 is also coupled to a cooling unit fourth conduit 418 of the cooling unit conduit system 400. The cooling unit fourth conduit 418 is configured to receive the cooling unit refrigerant from the downstream receiver 416.

In various embodiments, the downstream receiver 416 is configured such that liquid may flow freely from the downstream receiver 416 into the cooling unit fourth conduit 418 while vapor is retained within the downstream receiver 416. For example, an outlet of the downstream receiver 416 may located at an lowermost portion of the downstream receiver 416 such that gravity biases vapor away from the outlet, thereby causing the vapor to be retained within the downstream receiver 416. Vapor within the downstream receiver 416 may be cooled over time, thus turning into liquid which may flow out of the downstream receiver 416.

The cooling unit 104 also includes an evaporator 420 (e.g., heat exchanger, chiller, cooler, etc.). The cooling unit fourth conduit 418 extends within the evaporator 420 and the cooling unit first conduit 404 is coupled to the cooling unit fourth conduit 418 downstream of the evaporator 420. The evaporator 420 is configured to provide cooling to the target 106 associated with the cooling unit 104. As the evaporator 420 cools the target 106, the cooling unit refrigerant within the evaporator 420 is heated.

In operation, the cooling unit refrigerant has a first temperature in the cooling unit fourth conduit 418 upstream of the evaporator 420 and a second temperature within the cooling unit fourth conduit 418 downstream of the evaporator 420. A difference between the second temperature and the first temperature may be related to a configuration of the evaporator 420, ambient conditions (e.g., temperature, humidity, etc.) surrounding the evaporator 420, and/or a condition of the target 106.

The cooling unit 104 also includes a cooling unit controller 422. The cooling unit pump 402, the main power source 132, and the auxiliary power source 133 are electrically coupled and/or communicatively coupled to the cooling unit controller 422. With regard to the main power source 132 and the auxiliary power source 133, the cooling unit controller 422 is configured to receive power from the main power source 132 and/or the auxiliary power source 133. Additionally, the cooling unit controller 422 may include a battery that is configured to provide power to the cooling unit controller 422 during a period of time between when the main power source 132 ceases to provide power to the cooling unit controller 422 and when the auxiliary power source 133 provides power to the cooling unit controller 422 (e.g., thereby accounting for a starting time associated with the auxiliary power source 133, etc.).

In some embodiments, the condenser 412 is additionally electrically coupled to and/or communicatively coupled to the cooling unit controller 422. For example, the condenser 412 may include a controller, valves, fans, or other systems that could be controlled by the cooling unit controller 422. Similarly, the evaporator 420 may be electrically coupled and/or communicatively coupled to the cooling unit controller 422. For example, the evaporator 420 may include a controller, valves, fans, or other systems that could be controlled by the cooling unit controller 422.

Various sensors (e.g., temperature sensors, flow rate sensors, quality sensors, pressure sensors, etc.) may additionally be electrically coupled and/or communicatively coupled to the cooling unit controller 422. These various sensors may be capable of determining refrigerant parameters (e.g., temperature, flow rate, quality, pressure, volumetric flow rate, mass flow rate, etc.) of the cooling unit refrigerant and/or the second circuit refrigerant.

The cooling unit 104 also includes a cooling unit sensor 424. The cooling unit sensor 424 is configured to measure a refrigerant parameter of the cooling unit refrigerant. The cooling unit sensor 424 may be located at various locations within the cooling unit 104 such that refrigerant parameter at a target location may be monitored by the cooling unit sensor 424. In various embodiments, the cooling unit sensor 424 is coupled to the cooling unit second conduit 406 upstream of the upstream receiver 408. For example, the cooling unit sensor 424 may measure a temperature of the cooling unit refrigerant within the cooling unit second conduit 406 upstream of the upstream receiver 408. The cooling unit sensor 424 is electrically coupled and/or communicatively coupled to the cooling unit controller 422. As a result, the cooling unit controller 422 is configured to receive the refrigerant parameter from the cooling unit sensor 424.

The cooling unit controller 422 includes a cooling unit processing circuit 426. The cooling unit processing circuit 426 includes a cooling unit processor 428 and a cooling unit memory 430. The cooling unit processor 428 may include a microprocessor, an application-specific integrated circuit (ASIC), a field-programmable gate array (FPGA), other similar components, or combinations thereof. The cooling unit memory 430 may include, but is not limited to, electronic, optical, magnetic, or any other storage or transmission device capable of providing a processor, ASIC, FPGA, or other similar components, with program instructions. The cooling unit memory 430 may include a memory chip, Electrically Erasable Programmable Read-Only Memory (EEPROM), Erasable Programmable Read Only Memory (EPROM), flash memory, or any other suitable memory from which the cooling unit controller 422 can read instructions. The instructions may include code from any suitable programming language.

The cooling unit memory 430 may include various modules that include instructions which are configured to be implemented by the cooling unit processor 428. The cooling unit memory 430 includes a cooling unit pump module 432. The cooling unit pump module 432 includes instructions which are configured to be implemented by the cooling unit processor 428 to control operation of the cooling unit pump 402. The cooling unit memory 430 also includes a cooling unit sensor module 434. The cooling unit sensor module 434 includes instructions which are configured to be implemented by the cooling unit processor 428 to receive communications (e.g., refrigerant parameters, ambient parameters, etc.) from the cooling unit sensor 424. The cooling unit memory 430 includes a cooling unit power module 436. The cooling unit power module 436 includes instructions which are configured to be implemented by the cooling unit processor 428 to receive communications from the main power source 132 and the auxiliary power source 133.

The cooling unit controller 422 is configured to control operation of the cooling unit pump 402 (e.g., based on the instructions stored in the cooling unit pump module 432, etc.). For example, the cooling unit controller 422 may control an operating parameter (e.g., voltage supplied to the cooling unit pump 402, current supplied to the cooling unit pump 402, etc.) of the cooling unit pump 402 in order to achieve a target refrigerant parameter of the cooling unit refrigerant within the cooling unit conduit system 400. Additionally, the cooling unit controller 422 may control operation of the cooling unit pump 402 based on whether power is provided by the main power source 132 or the auxiliary power source 133.

The cooling unit controller 422 is configured to facilitate interactions with the cooling unit sensor 424 (e.g., based on the instructions stored in the cooling unit sensor module 434, etc.). For example, the cooling unit controller 422 may periodically (e.g., once an hour, etc.) utilize the refrigerant parameter provided by the cooling unit sensor 424. Additionally, the cooling unit controller 422 may facilitate interactions with the cooling unit sensor 424 based on whether power is provided by the main power source 132 or the auxiliary power source 133.

The cooling unit controller 422 is configured to control operation of the auxiliary power source 133 (e.g., based on the instructions stored in the cooling unit power module 436, etc.). For example, the cooling unit controller 422 may cause the auxiliary power source 133 to be turned on in response to determining that the main power source 132 has failed and/or is unavailable.

The cooling unit 104 includes a cooling unit high PRV 438 (e.g., blow-off valve, etc.) disposed along the cooling unit second conduit 406. The cooling unit high PRV 438 is configured to open when a pressure of the cooling unit refrigerant within the cooling unit second conduit 406 exceeds a high pressure threshold. In this way, the cooling unit high PRV 438 may protect the cooling unit 104 from impacts of the over-pressurized cooling unit refrigerant. In various embodiments, the high pressure threshold is approximately equal to (e.g., within 5% of, etc.) between 50 bar and 75 bar, inclusive (e.g., 48 bar, 50 bar, 55 bar, 65 bar, 75 bar, 77 bar, etc.).

The cooling unit 104 also includes a cooling unit low PRV 440 (e.g., blow-off valve, etc.) disposed along the cooling unit first conduit 404. The cooling unit low PRV 440 is configured to open when a pressure of the cooling unit refrigerant within the cooling unit first conduit 404 exceeds a low pressure threshold. In this way, the cooling unit low PRV 440 may protect the cooling unit 104 from impacts of the over-pressurized cooling unit refrigerant. The high pressure threshold is greater than the low pressure threshold. In various embodiments, the low pressure threshold is approximately equal to (e.g., within 5% of, etc.) between 35 bar and 50 bar, inclusive (e.g., 33 bar, 35 bar, 40 bar, 45 bar, 50 bar, 52 bar, etc.).

In various embodiments, the cooling unit 104 additionally includes a reserve power source 441 (e.g., generator, battery bank, capacitor, etc.). The reserve power source 441 is electrically coupled to, and configured to provide power to and receive power from, the cooling unit controller 422. The reserve power source 441 is configured to provide power to the cooling unit 104 when the cooling unit 104 is disconnected from the main power source 132 and the auxiliary power source 133 (e.g., during warm-up of the auxiliary power source 133, during transport of the cooling unit 104, etc.). In some embodiments, the reserve power source 441 includes a controller, valves, fans, or other systems that could utilize the power from the reserve power source 441. As is explained in more detail herein, the reserve power source 441 may enable the cooling unit 104 to perform various functions after being disconnected from the main power source 132 and the auxiliary power source 133.

VI. Example Transfer System

In various embodiments, the cooling unit 104 also includes a transfer system 442. As is explained in more detail herein, the transfer system 442 is configured to facilitate transfer (e.g., venting, etc.) of the cooling unit refrigerant from upstream of the cooling unit pump 402 to downstream of the cooling unit pump 402, thereby decreasing pressure of the cooling unit refrigerant downstream of the cooling unit pump 402.

The transfer system 442 includes a transfer system conduit 444. The transfer system conduit 444 is configured to receive the cooling unit refrigerant from upstream of the cooling unit pump 402 and is coupled to the cooling unit second conduit 406 (e.g., downstream of the cooling unit pump 402).

The transfer system 442 also includes a transfer system upstream control valve 446 (e.g., three-way valve, ball valve, solenoid valve, etc.) disposed along the cooling unit first conduit 404 (e.g., coupled to an upstream portion of the cooling unit first conduit 404 and coupled to a downstream portion of the cooling unit first conduit 404). The transfer system upstream control valve 446 is also coupled to the transfer system conduit 444. The transfer system upstream control valve 446 is configured to selectively provide the cooling unit refrigerant from upstream of the transfer system upstream control valve 446 to the cooling unit first conduit 404 downstream of the transfer system upstream control valve 446 and/or to the transfer conduit 444. The transfer system upstream control valve 446 is also configured to provide the cooling unit refrigerant from the transfer conduit 444 to the cooling unit first conduit 404 downstream of the transfer system upstream control valve 446.

The transfer system upstream control valve 446 is operable between a first position, where the cooling unit first conduit 404 (e.g., downstream of the transfer system upstream control valve 446) is configured to receive the cooling unit refrigerant from the cooling unit first conduit 404 (e.g., upstream of the transfer system upstream control valve 446) through the transfer system upstream control valve 446, a second position, where the transfer conduit 444 is configured to receive the cooling unit refrigerant from the cooling unit first conduit 404 (e.g., upstream of the transfer system upstream control valve 446) through the transfer system upstream control valve 446, and a third position, where: (i) the cooling unit first conduit 404 is configured to receive the cooling unit refrigerant from the cooling unit first conduit 404 through the transfer system upstream control valve 446 and (ii) the transfer conduit 444 is configured to receive the cooling unit refrigerant from the cooling unit first conduit 404 through the transfer system upstream control valve 446.

In some embodiments, the transfer system upstream control valve 446 is additionally operable in a fourth position in which the cooling unit first conduit 404 (e.g., upstream of the transfer system upstream control valve 446) is isolated from the cooling unit first conduit 404 (e.g., downstream of the transfer system upstream control valve 446) and the transfer conduit 444. As a result, the cooling unit pump 402 does not receive the cooling unit refrigerant from the transfer system upstream control valve 446. Additionally, the transfer conduit 444 does not receive the cooling unit refrigerant from the transfer system upstream control valve 446.

In some embodiments, the transfer system upstream control valve 446 is additionally operable in a fifth position where the transfer conduit 444 is configured to provide the cooling unit refrigerant to the cooling unit first conduit 404 (e.g., downstream of the transfer system upstream control valve 446) through the transfer system upstream control valve 446.

The transfer system 442 also includes a transfer system downstream control valve 447 (e.g., three-way valve, ball valve, solenoid valve, etc.) disposed along the cooling unit second conduit 406 (e.g., coupled to an upstream portion of the cooling unit second conduit 406 and coupled to a downstream portion of the cooling unit second conduit 406). The transfer system downstream control valve 447 is also coupled to the transfer system conduit 444. The transfer system downstream control valve 447 is configured to selectively provide the cooling unit refrigerant from upstream of the transfer system downstream control valve 447 to the cooling unit second conduit 406 downstream of the transfer system downstream control valve 447 and/or to the transfer conduit 444. The transfer system downstream control valve 447 is also configured to receive the cooling unit refrigerant from the transfer conduit 444 and provide the cooling unit refrigerant to the cooling unit first conduit 404 downstream of the transfer system downstream control valve 447.

The transfer system downstream control valve 447 is operable between a first position, where the cooling unit second conduit 406 (e.g., downstream of the transfer system downstream control valve 447) is configured to receive the cooling unit refrigerant from the cooling unit second conduit 406 (e.g., upstream of the transfer system downstream control valve 447) through the transfer system downstream control valve 447, and a second position, where the transfer conduit 444 is configured to provide the cooling unit refrigerant to the cooling unit second conduit 406 (e.g., downstream of the transfer system downstream control valve 447) through the transfer system downstream control valve 447.

In some embodiments, the transfer system downstream control valve 447 is additionally operable in a third position where: (i) the cooling unit second conduit 406 is configured to receive the cooling unit refrigerant from the cooling unit second conduit 406 through the transfer system downstream control valve 447 and (ii) the transfer conduit 444 is configured to receive the cooling unit refrigerant from the cooling unit second conduit 406 through the transfer system downstream control valve 447.

In some embodiments, the transfer system downstream control valve 447 is additionally operable in a fourth position where the transfer conduit 444 is configured to receive the cooling unit refrigerant from the cooling unit first conduit 404 (e.g., upstream of the transfer system upstream control valve 446) through the transfer system upstream control valve 446.

The transfer system downstream control valve 447 may cooperate with the transfer system upstream control valve 446 to control when the cooling unit refrigerant is provided through the transfer conduit 444 so as to bypass the cooling unit pump 402. By bypassing the cooling unit pump 402, the cooling unit refrigerant is vented from the "low pressure" side of the cooling unit 104 to the "high pressure" side of the cooling unit 104. Such venting may be desirable when the cooling unit 104 is not circulating the cooling unit refrigerant (e.g., during a loss of power event, etc.) and a pressure of the cooling unit refrigerant upstream of the cooling unit pump 402 (e.g., within the cooling unit first conduit 404) exceeds a threshold pressure that is less than the low pressure threshold associated with the cooling unit low PRV 440. As a result of venting the cooling unit refrigerant from the cooling unit first conduit 405 to the cooling unit second conduit 406, the transfer system 442 decreases a pressure of the cooling unit refrigerant within the cooling unit first conduit 404. In this way, the transfer system 442 may mitigate increases in pressure of the cooling unit refrigerant that may occur when a temperature of the cooling unit refrigerant rises.

Additionally, the transfer system downstream control valve 447 may cooperate with the transfer system upstream control valve 446 to control when the cooling unit refrigerant is provided through the transfer conduit 444 so as to bypass the upstream receiver 408, the condenser 412, the downstream receiver 416, and the evaporator 420. By bypassing the upstream receiver 408, the condenser 412, the downstream receiver 416, and the evaporator 420, the cooling unit refrigerant is provided as relatively hot vapor back to the cooling unit first conduit 404. This may increase a temperature of the refrigerant received by the cooling unit pump 402. By controlling the transfer system upstream control valve 446 and the transfer system downstream control valve 447, a target superheat of the cooling unit refrigerant received by the cooling unit pump 402 may be achieved. By achieving the target superheat, desirable operation of the cooling unit pump 402 may be facilitated. Prior to achieving the target superheat, the cooling unit pump 402 may be controlled by a variable speed drive or other controlling mechanism to safeguard the cooling unit pump 402.

The cooling unit memory 430 also includes a transfer system control valve module 448. The transfer system control valve module 448 includes instructions which are configured to be implemented by the cooling unit processor 428 to control operation of the transfer system upstream control valve 446 and the transfer system downstream control valve 447. The cooling unit controller 422 is configured to control operation of the transfer system upstream control valve 446 (e.g., based on the instructions stored in the transfer system control valve module 448, etc.) and the transfer system downstream control valve 447 (e.g., based on the instructions stored in the transfer system control valve module 448, etc.). For example, the cooling unit controller 422 may selectively reposition (e.g., from the first position to the second position, from the first position to the third position, from the second position to the first position, from the second position to the third position, from the third position to the first position, from the third position to the second position, etc.) the transfer system upstream control valve 446 and/or the transfer system downstream control valve 447.

Additionally, the cooling unit controller 422 may control operation of the transfer system upstream control valve 446 and/or the transfer system downstream control valve 447 based on whether power is provided by the main power source 132, the auxiliary power source 133, or the reserve power source 441. For example, the cooling unit controller 422 may initiate a timer in response to a loss of power event (e.g., in response to losing power from the main power source 132, etc.) and compare the timer to a threshold. When the timer exceeds the threshold, the cooling unit controller 422 may reposition the transfer system upstream control valve 446 (e.g., from the first position to the second position, etc.) and/or the transfer system downstream control valve 447 to cause the cooling unit refrigerant to flow from the cooling unit first conduit 404 to the transfer conduit 444.

VII. Example Expansion System

In various embodiments, the cooling unit 104 also includes an expansion system 450. As is explained in more detail herein, the expansion system 450 is configured to facilitate expansion of the cooling unit refrigerant upstream of the cooling unit pump 402, thereby decreasing a pressure of the cooling unit refrigerant upstream of the cooling unit pump 402.

The expansion system 450 includes an expansion system first conduit 452. The expansion system first conduit 452 is coupled to the cooling unit first conduit 404. The expansion system 450 also includes an expansion system second conduit 454. The expansion system second conduit 454 is coupled to the cooling unit second conduit 406. The expansion system 450 also includes an expansion system third conduit 458. The expansion system third conduit 458 is configured to receive the cooling unit refrigerant from the expansion system first conduit 452 and from the expansion system second conduit 454 and to provide the cooling unit refrigerant to the expansion system first conduit 452 and to the expansion system second conduit 454.

The expansion system 450 also includes an expansion system upstream control valve 460 (e.g., three-way valve, ball valve, solenoid valve, etc.). The expansion system upstream control valve 460 is coupled to the expansion system first conduit 452 and the expansion system third conduit 456. The expansion system upstream control valve 460 is configured to selectively provide the cooling unit refrigerant from the expansion system first conduit 452, and therefore from the cooling unit first conduit 404, to the expansion system third conduit 456, and to provide the cooling unit refrigerant from the expansion system third conduit 456 to the expansion system first conduit 452, and therefore to the cooling unit first conduit 404. In some embodiments, the expansion system upstream control valve 460 includes an expansion system upstream control valve vent 462 that is configured to expel the cooling unit refrigerant from the cooling unit 104 (e.g., to atmosphere).

The expansion system upstream control valve 460 is operable between a first position, where the expansion system first conduit 452 is not connected to the expansion system third conduit 456 (e.g., such that the cooling unit first conduit 404 is isolated from the expansion system third conduit 456) and a second position where the expansion system first conduit 452 is connected to the expansion system third conduit 456 (e.g., such that the cooling unit first conduit 404 is not isolated from the expansion system third conduit 456). As a result, the expansion system upstream control valve 460 is configured to control a flow of the cooling unit refrigerant between the cooling unit first conduit 404 and the expansion system third conduit 456.

In some embodiments, the expansion system upstream control valve 460 is additionally operable in a third position in which the expansion system first conduit 452 is connected to the expansion system upstream control valve vent 462. As a result, the expansion system upstream control valve 460 is configured to vent the cooling unit refrigerant from the expansion system first conduit 452, and therefore from the cooling unit first conduit 404, to atmosphere.

In some embodiments, the expansion system upstream control valve 460 is additionally operable in a fourth position in which the expansion system third conduit 456 is connected to the expansion system upstream control valve vent 462. As a result, the expansion system upstream control valve 460 is configured to vent the cooling unit refrigerant from the expansion system third conduit 456 to atmosphere.

The expansion system 450 also includes an expansion system downstream control valve 464 (e.g., three-way valve, ball valve, solenoid valve, etc.). The expansion system downstream control valve 464 is coupled to the expansion system second conduit 454 and the expansion system third conduit 456. The expansion system downstream control valve 464 is configured to selectively provide the cooling unit refrigerant from the expansion system second conduit 454, and therefore from the cooling unit second conduit 406, to the expansion system third conduit 456, and to provide the cooling unit refrigerant from the expansion system third conduit 456 to the expansion system second conduit 454, and therefore to the cooling unit second conduit 406. In some embodiments, the expansion system downstream control valve 464 includes an expansion system downstream control valve vent 466 that is configured to expel the cooling unit refrigerant from the cooling unit 104 (e.g., to atmosphere).

The expansion system downstream control valve 464 is operable between a first position, where the expansion system second conduit 454 is not connected to the expansion system third conduit 456 (e.g., such that the cooling unit second conduit 406 is isolated from the expansion system third conduit 456) and a second position where the expansion system second conduit 454 is connected to the expansion system third conduit 456 (e.g., such that the cooling unit second conduit 406 is not isolated from the expansion system third conduit 456). As a result, the expansion system downstream control valve 464 is configured to control a flow of the cooling unit refrigerant between the cooling unit second conduit 406 and the expansion system third conduit 456.

In some embodiments, the expansion system downstream control valve 464 is additionally operable in a third position in which the expansion system second conduit 454 is connected to the expansion system downstream control valve vent 466. As a result, the expansion system downstream control valve 464 is configured to vent the cooling unit refrigerant from the expansion system second conduit 454, and therefore from the cooling unit second conduit 406, to atmosphere.

In some embodiments, the expansion system downstream control valve 464 is additionally operable in a fourth position in which the expansion system third conduit 456 is connected to the expansion system downstream control valve vent 466. As a result, the expansion system downstream control valve 464 is configured to vent the cooling unit refrigerant from the expansion system third conduit 456 to atmosphere.

The expansion system 450 also includes an expansion tank 468 (e.g., vessel, etc.). The expansion tank 468 is disposed along the expansion system third conduit 456. As is explained in more detail herein, the expansion tank 468 is configured to contain the cooling unit refrigerant.

The cooling unit memory 430 also includes an expansion system control valve module 470. The expansion system control valve module 470 includes instructions which are configured to be implemented by the cooling unit processor 428 to control operation of the expansion system upstream control valve 460 and the expansion system downstream control valve 464. The cooling unit controller 422 is configured to control operation of the expansion system upstream control valve 460 (e.g., based on the instructions stored in the expansion system control valve module 470, etc.) and to control operation of the expansion system downstream control valve 464 (e.g., based on the instructions stored in the expansion system control valve module 470, etc.). For example, the cooling unit controller 422 may selectively reposition (e.g., from the first position to the second position, from the first position to the third position, from the second position to the first position, from the second position to the third position, from the third position to the first position, from the third position to the second position, etc.) the expansion system upstream control valve 460 and/or the expansion system downstream control valve 464.

Additionally, the cooling unit controller 422 may control operation of the expansion system upstream control valve 460 and/or the expansion system downstream control valve 464 based on whether power is provided by the main power source 132, the auxiliary power source 133, or the reserve power source 441. For example, the cooling unit controller 422 may initiate a timer in response to a loss of power event (e.g., in response to losing power from the main power source 132, etc.) and compare the timer to a threshold. When the timer exceeds the threshold, the cooling unit controller 422 may reposition the expansion system upstream control valve 460 and/or the expansion system downstream control valve 464.

When the cooling unit 104 is receiving power from the main power source 132, the expansion system upstream control valve 460 is in the second position (e.g., where the expansion system first conduit 452 is connected to the expansion system third conduit 456) and the expansion system downstream control valve 464 is in the first position (e.g., where the expansion system second conduit 454 is not connected to the expansion system third conduit 456). As a result, the cooling unit refrigerant (e.g., in vapor form, etc.) is provided from the cooling unit first conduit 404 to the expansion tank 468.

When the cooling unit 104 ceases to receive power from the main power source 132, the auxiliary power source 133, or the reserve power source 441 (e.g., such as when the cooling unit 104 has been disconnected from the cooling system 100 and is in transit, etc.), the expansion system upstream control valve 460 transitions from the second position to the first position (e.g., where the expansion system first conduit 452 is not connected to the expansion system third conduit 456) and the expansion system downstream control valve 464 transitions from the first position to the second position (e.g., where the expansion system second conduit 454 is connected to the expansion system third conduit 456). As a result, the cooling unit refrigerant (e.g., in liquid form, etc.) is provided from the cooling unit second conduit 406 to the expansion tank 468. In this way, the expansion tank 468 provides an increased volume for the cooling unit refrigerant upstream of the cooling unit pump 402, thereby decreasing pressure of the cooling unit refrigerant within the cooling unit second conduit 406. By decreasing a pressure of the cooling unit refrigerant within the cooling unit second conduit 406, the expansion system 450 functions to lengthen the amount of time before the pressure of the cooling unit refrigerant within the cooling unit second conduit 406 exceeds the high pressure threshold associated with the cooling unit high PRV 438.

When the cooling unit 104 again receives power from the main power source 132 (e.g., after the cooling unit 104 has been reconnected to the cooling system 100, etc.) or receives power from the auxiliary power source 133, the expansion system upstream control valve 460 transitions from the first position to the second position (e.g., where the expansion system first conduit 452 is connected to the expansion system third conduit 456) and the expansion system downstream control valve 464 transitions from the second position to the first position (e.g., where the expansion system second conduit 454 is not connected to the expansion system third conduit 456). As a result, the cooling unit refrigerant is provided from the expansion tank 468 to the cooling unit first conduit 404.

In various embodiments, the expansion tank 468 is a replaceable tank that is configured to be coupled to, and decoupled from, the expansion system third conduit 456. For example, the expansion system third conduit 456 may include two male couplings and the expansion tank 468 may include two female coupling that are each configured to be coupled to, and decoupled from, one of the male couplings of the expansion system third conduit 456. In such embodiments, the expansion tank 468 may be designed, for example, to accommodate elevated temperatures and pressures required for shipping.

When the expansion tank 468 is not coupled to the expansion system third conduit 456, the expansion system upstream control valve 460 is in the first position (e.g., where the expansion system first conduit 452 is not connected to the expansion system third conduit 456) and the expansion system downstream control valve 464 is in the first position (e.g., where the expansion system second conduit 454 is not connected to the expansion system third conduit 456). As a result, the cooling unit refrigerant does not flow through the expansion system third conduit 456. Once the expansion tank 468 has been coupled to the expansion system third conduit 456, the expansion system upstream control valve 460 may be transitioned out of the first position and/or the expansion system downstream control valve 464 may be transitioned out of the first position.

In some embodiments, the expansion tank 468 is charged with the cooling unit refrigerant prior to being coupled to the expansion system third conduit 456. As a result, additional refrigerant can be added to the cooling unit 104 by coupling the expansion tank 468 to the expansion system third conduit 456. This may be particularly beneficial after, for example, a loss of power event when a portion of the cooling unit refrigerant has been vented via the cooling unit high PRV 438 and/or the cooling unit low PRV 440.

In these embodiments, the cooling unit refrigerant may be provided from the expansion tank 468 into the cooling unit first conduit 404 by repositioning the transfer system upstream control valve 446 and/or into the cooling unit second conduit 406 by repositioning the transfer system downstream control valve 447. The cooling unit refrigerant may be provided from the expansion tank 468 into the cooling unit first conduit 404 and/or the cooling unit second conduit 406 in response to, for example, a refrigerant parameter of the cooling unit refrigerant being outside a target threshold. For example, if a pressure of the cooling unit refrigerant drops below a target pressure, the transfer system upstream control valve 446 and/or the transfer system downstream control valve 447 may be caused to provide the cooling unit refrigerant from the expansion tank 468 into the cooling unit first conduit 404 and/or the cooling unit second conduit 406.

In some situations, it may be desirable to purge air within the expansion system third conduit 456 prior to providing refrigerant from the expansion tank 468 to the cooling unit first conduit 404 and/or the cooling unit second conduit 406. In these situations, and after coupling the expansion tank 468 to the expansion system third conduit 456, the expansion system upstream control valve 460 may be caused to be in the fourth position (e.g., where the expansion system third conduit 456 is connected to the expansion system upstream control valve vent 462 and isolated from the expansion system first conduit 452) such that the pressurized refrigerant within the expansion tank 468 purges air from the expansion system third conduit 456 via the expansion system upstream control valve vent 462. Similarly, the expansion system downstream control valve 464 may be caused to be in the fourth position (e.g., where the expansion system third conduit 456 is connected to the expansion system downstream control valve vent 466 and isolated from the expansion system second conduit 454) such that the pressurized refrigerant within the expansion tank 468 purges air from the expansion system third conduit 456 via the expansion system downstream control valve vent 466.

VIII. Example Chilling System

In various embodiments, the cooling unit 104 also includes a chilling system 472. As is explained in more detail herein, the chilling system 472 is configured to facilitate cooling of the cooling unit refrigerant from upstream of the cooling unit pump 402 using the cooling unit refrigerant within, or near, the evaporator 420.

The chilling system 472 includes a chilling system first conduit 474. As is explained in more detail herein, the chilling system first conduit 474 is configured to receive the cooling unit refrigerant from the cooling unit second conduit 406. The chilling system 472 also includes a chilling system second conduit 476. As is explained in more detail herein, the chilling system second conduit 476 is configured to provide the cooling unit refrigerant to the cooling unit first conduit 404.

The chilling system 472 also includes a chilling system control valve 478 (e.g., three-way valve, ball valve, solenoid valve, etc.). The chilling system control valve 478 is disposed along the cooling unit second conduit 406 and coupled to the chilling system first conduit 474. The chilling system control valve 478 is configured to selectively provide the cooling unit refrigerant from the cooling unit second conduit 406 (e.g., upstream of the chilling system control valve 478, etc.) to the cooling unit second conduit 406 (e.g., downstream of the chilling system control valve 478, etc.) and to provide the cooling unit refrigerant from the cooling unit second conduit 406 (e.g., upstream of the chilling system control valve 478, etc.) to the chilling system first conduit 474.

The chilling system control valve 478 is operable between a first position, where the cooling unit second conduit 406 (e.g., upstream of the chilling system control valve 478, etc.) is connected to the cooling unit second conduit 406 (e.g., such that the cooling unit second conduit 406 is isolated from the chilling system first conduit 474) and a second position where the cooling unit second conduit 406 (e.g., upstream of the chilling system control valve 478, etc.) is connected to the chilling system first conduit 474 (e.g., such that the cooling unit second conduit 406 is not isolated from the chilling system first conduit 474). As a result, the chilling system control valve 478 is configured to control a flow of the cooling unit refrigerant between the cooling unit second conduit 406 and the chilling system first conduit 474.

In some embodiments, the chilling system control valve 478 is additionally operable in a third position in which the cooling unit second conduit 406 (e.g., upstream of the chilling system control valve 478, etc.) is connected to both the chilling system first conduit 474 and the cooling unit second conduit 406 (e.g., downstream of the chilling system control valve 478, etc.).

The chilling system 472 also includes a chilling tank 480 (e.g., vessel, etc.). The chilling tank 480 is coupled to the chilling system first conduit 474 and the chilling system second conduit 476. As is explained in more detail herein, the chilling tank 480 is configured to receive the cooling unit refrigerant from the chilling system first conduit 474, provide the cooling unit refrigerant to the chilling system second conduit 476, and contain the cooling unit refrigerant.

The chilling tank 480 is located in close physical proximity to the evaporator 420. For example, the chilling tank 480 may be located within a target distance of the evaporator 420 (e.g., such that no portion of the chilling tank 480 is separated from the evaporator by a distance greater than the target distance). In various embodiments, the target distance is approximately equal to between 2 inches and 16 inches, inclusive.

As a result, cooling provided by the evaporator 420 is provided to the chilling tank 480 (e.g., along with the target 106, etc.). Therefore, in the event that circulation of the cooling unit refrigerant through the cooling unit 104 is ceased, cooling provided by the evaporator 420 (e.g., due to the cooling unit refrigerant within the evaporator 420, etc.) may be provided to the chilling tank 480. The chilling tank 480 may contain refrigerant during such situations. Therefore, the evaporator 420 may be utilized to provide cooling to the cooling unit refrigerant when the circulation of the cooling unit refrigerant through the cooling unit 104 is ceased. As a result, an increase in the pressure of the cooling unit refrigerant during such situations may be minimized.

The chilling system 472 also includes a chilling system first check valve 482 (e.g., one-way valve, etc.) disposed along the chilling system first conduit 474. The chilling system first check valve 482 may prohibit backflow of the cooling unit refrigerant from the chilling tank 480 to the cooling unit second conduit 406.

The chilling system 472 also includes a chilling system second check valve 484 (e.g., one-way valve, etc.) disposed along the chilling system second conduit 476. The chilling system second check valve 484 may prohibit backflow of the cooling unit refrigerant from the cooling unit first conduit 404 to the chilling tank 480.

The cooling unit memory 430 also includes a chilling system control valve module 486. The chilling system control valve module 486 includes instructions which are configured to be implemented by the cooling unit processor 428 to control operation of the chilling system control valve 478. The cooling unit controller 422 is configured to control operation of the chilling system control valve 478 (e.g., based on the instructions stored in the chilling system control valve module 486, etc.). For example, the cooling unit controller 422 may selectively reposition (e.g., from the first position to the second position, from the first position to the third position, from the second position to the first position, from the second position to the third position, from the third position to the first position, from the third position to the second position, etc.) the chilling system control valve 478.

Additionally, the cooling unit controller 422 may control operation of the chilling system control valve 478 based on whether power is provided by the main power source 132, the auxiliary power source 133, or the reserve power source 441. For example, the cooling unit controller 422 may initiate a timer in response to a loss of power event (e.g., in response to losing power from the main power source 132, etc.) and compare the timer to a threshold. When the timer exceeds the threshold, the cooling unit controller 422 may reposition the chilling system control valve 478.

When the cooling unit 104 is receiving power from the main power source 132, the chilling system control valve 478 is in the first position (e.g., where the cooling unit second conduit 406 is isolated from the chilling system first conduit 474). As a result, the cooling unit refrigerant bypasses the chilling system 472.

When the cooling unit 104 ceases to receive power from the main power source 132, the auxiliary power source 133, or the reserve power source 441, the chilling system control valve 478 transitions from the first position to the second position (e.g., where the cooling unit second conduit 406 is connected to the chilling system first conduit 474).

As a result, the cooling unit refrigerant flows from the cooling unit second conduit 406 upstream of the chilling system control valve 478 into the chilling system control valve 478 and from the chilling system control valve 478 into the chilling system first conduit 474. The cooling unit refrigerant then flows through the chilling system first check valve 482 and into the chilling tank 480. The chilling tank 480 receives cooling provided by the evaporator 420. This cooling causes cooling of the cooling unit refrigerant within the chilling tank 480. By cooling the cooling unit refrigerant, an increase in pressure of the cooling unit refrigerant due to an ambient environment surrounding the cooling unit 104 is minimized.

Additionally, the chilling tank 480 provides an increased volume for the cooling unit refrigerant upstream of the cooling unit pump 402, thereby decreasing pressure of the cooling unit refrigerant within the cooling unit second conduit 406. By decreasing a pressure of the cooling unit refrigerant within the cooling unit second conduit 406, the chilling system 472 functions to lengthen the amount of time before the pressure of the cooling unit refrigerant within the cooling unit second conduit 406 exceeds the high pressure threshold associated with the cooling unit high PRV 438.

The chilling system second conduit 476 is coupled to the chilling tank 480 so as to minimize transmission of liquid into the chilling system second conduit 476. For example, the chilling system second conduit 476 and/or the chilling tank 480 may be configured such that vapor may flow freely from the chilling tank 480 into the chilling system second conduit 476 while liquid is retained within the chilling tank 480. In some embodiments, an outlet of the chilling tank 480 that is coupled to the chilling system second conduit 476 is located at an uppermost portion of the chilling tank 480 such that gravity biases liquid away from the outlet, thereby causing the liquid to be retained within the chilling tank 480. By being configured to mitigate transmission of liquid to the chilling system second conduit 476, the cooling unit pump 402 may be protected from cavitation.

While the cooling unit 104 is not receiving power from the main power source 132, the auxiliary power source 133, or the reserve power source 441, the cooling unit refrigerant may flow from the chilling tank 480 into the chilling system second conduit 476, through the chilling system second check valve 484, and to the cooling unit first conduit 404. As a result, the cooling unit low PRV 440 continues to provide a mechanism for mitigating against undesirable pressures of the cooling unit refrigerant.

When the cooling unit 104 again receives power from the main power source 132 (e.g., after the cooling unit 104 had ceased to receive power from the main power source 132) or receives power from the auxiliary power source 133, the chilling system control valve 478 transitions from the second position to the first position (e.g., where the cooling unit second conduit 406 is isolated from the chilling system first conduit 474).

While vapor may exit the chilling tank 480 via the chilling system second conduit 476, liquid may be retained within the chilling tank 480. In some embodiments, it is desired for the liquid to exit the chilling tank 480. In such embodiments, the chilling tank 480 is heated to cause the liquid to transition to vapor which may exit the chilling tank 480 via the chilling system second conduit 476. In various embodiments, the cooling unit 104 includes a chilling tank heater 488 (e.g., electric heater, heat exchanger, etc.) that is coupled to the cooling unit 104 and configured to heat liquid within the cooling unit 104. For example, the cooling unit controller 422 may cause the chilling tank heater 488 to turn on, and therefore provide heating to the liquid within the chilling tank 480, in response to the cooling unit 104 again receiving power from the main power source 132 or the auxiliary power source 133.

IX. First Example Operation of the Transfer System

Figure 5:
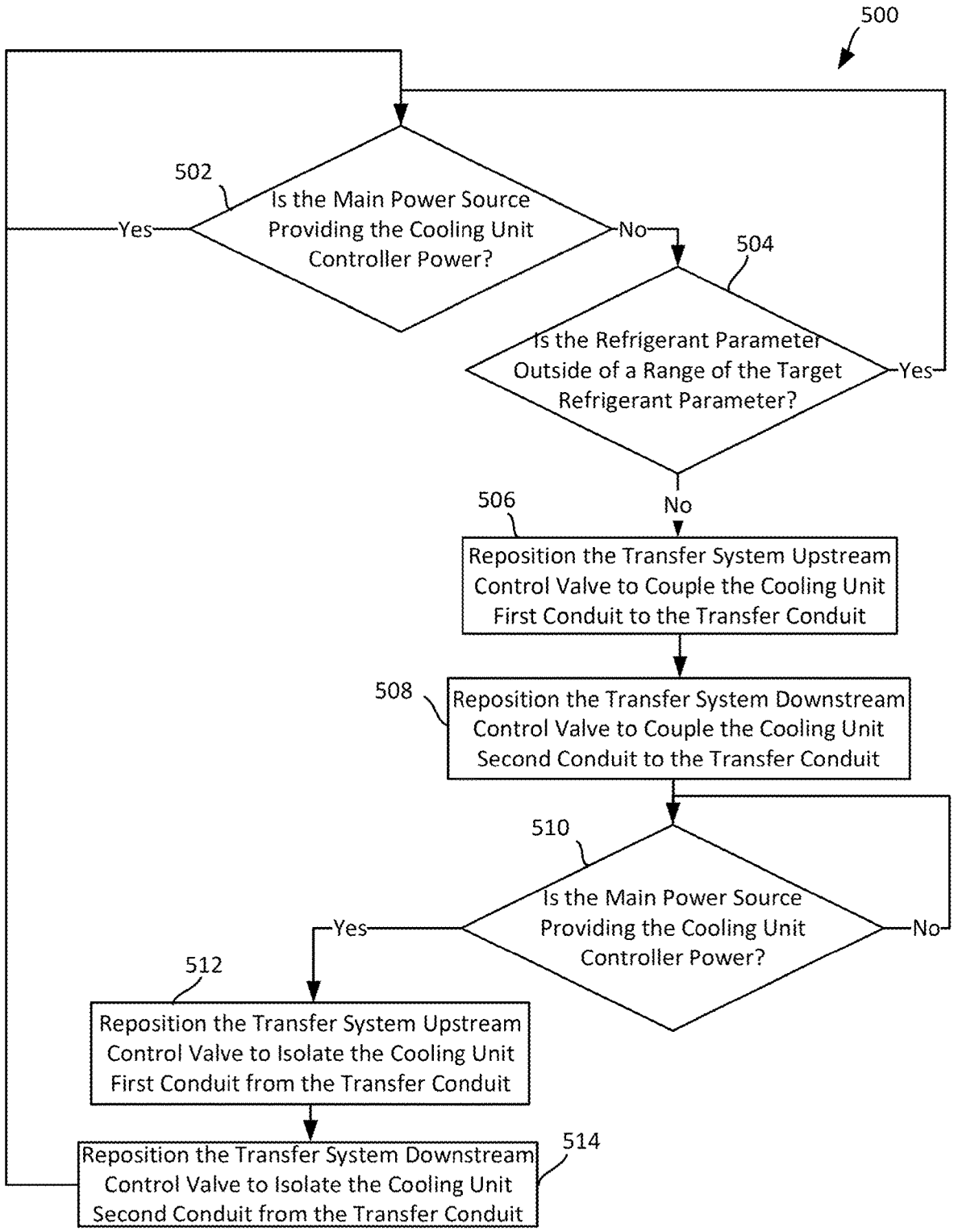
FIG. 5 is a block diagram of an example method of utilizing a transfer system of a cooling unit.

As shown in FIG. 5, a method 500 of utilizing the transfer system 442 to transfer the cooling unit refrigerant from downstream of the cooling unit pump 402 to upstream of the cooling unit pump 402.

The method 500 begins in block 502 with determining, by the cooling unit controller 422 (e.g., via the cooling unit power module 436, etc.), if the main power source 132 is providing the cooling unit controller 422 with power. For example, the cooling unit controller 422 may monitor a current and/or voltage provided by the main power source 132 and determine that the main power source 132 is not providing the cooling unit controller 422 power when the current and/or voltage drops below a threshold (e.g., a minimum current, a minimum voltage, etc.). If the cooling unit controller 422 determines that the main power source 132 is providing the cooling unit controller 422 with power, the method 500 restarts (e.g., ends and continues to block 502 again, etc.).

If the cooling unit controller 422 determines that the main power source 132 is not providing the cooling unit controller 422 with power, the method 500 continues in block 504 with determining, by the cooling unit controller 422, if the refrigerant parameter measured by the cooling unit sensor 424 is within a range (e.g., 2%, 5%, 10%, etc.) of a target refrigerant parameter. For example, the cooling unit controller 422 may determine that the pressure of the cooling unit refrigerant is outside of the range of the target pressure. If the cooling unit controller 422 determines that the refrigerant parameter is within the range of the target refrigerant parameter, the method 500 restarts (e.g., ends and continues to block 502 again, etc.).

If the cooling unit controller 422 determines that the refrigerant parameter is not within the range of the target refrigerant pressure, the method 500 continues in block 506 with repositioning the transfer system upstream control valve 446 to couple the cooling unit first conduit 404, upstream of the transfer system upstream control valve 446, to the transfer conduit 444. The method 500 then continues in block 508 with repositioning the transfer system downstream control valve 447 to couple the cooling unit second conduit 406, downstream of the transfer system downstream control valve 447, to the transfer conduit 444. As a result, the cooling unit refrigerant is provided from upstream of the cooling unit pump 402 around the cooling unit pump 402 and downstream of the cooling unit pump 402, thereby bypassing the cooling unit pump 402.

The method 500 continues in block 510 with determining, by the cooling unit controller 422 (e.g., via the cooling unit power module 436, etc.), if the main power source 132 is providing the cooling unit controller 422 with power. For example, the cooling unit controller 422 may monitor a current and/or voltage provided by the main power source 132 and determine that the main power source 132 is providing the cooling unit controller 422 power when the current and/or voltage drops exceeds a threshold (e.g., a minimum current, a minimum voltage, etc.). If the cooling unit controller 422 determines that the main power source 132 is not providing the cooling unit controller 422 with power, the method 500 continues back to block 510 again.

If the cooling unit controller 422 determines that the main power source 132 is providing the cooling unit controller 422 with power, the method 500 continues in block 512 with repositioning the transfer system upstream control valve 446 to isolate the cooling unit first conduit 404 from the transfer conduit 444 (e.g., to couple the cooling unit first conduit 404 upstream of the transfer system upstream control valve 446 to the cooling unit first conduit 404 downstream of the transfer system upstream control valve 446). The method 500 then continues in block 514 with repositioning the transfer system downstream control valve 447 to isolate the cooling unit second conduit 406 from the transfer conduit 444 (e.g., to couple the cooling unit second conduit 406 upstream of the transfer system downstream control valve 447 to the cooling unit second conduit 406 downstream of the transfer system downstream control valve 447). The method 500 then restarts (e.g., ends and continues to block 502 again, etc.).

X. Second Example Operation of the Transfer System

Figure 6:
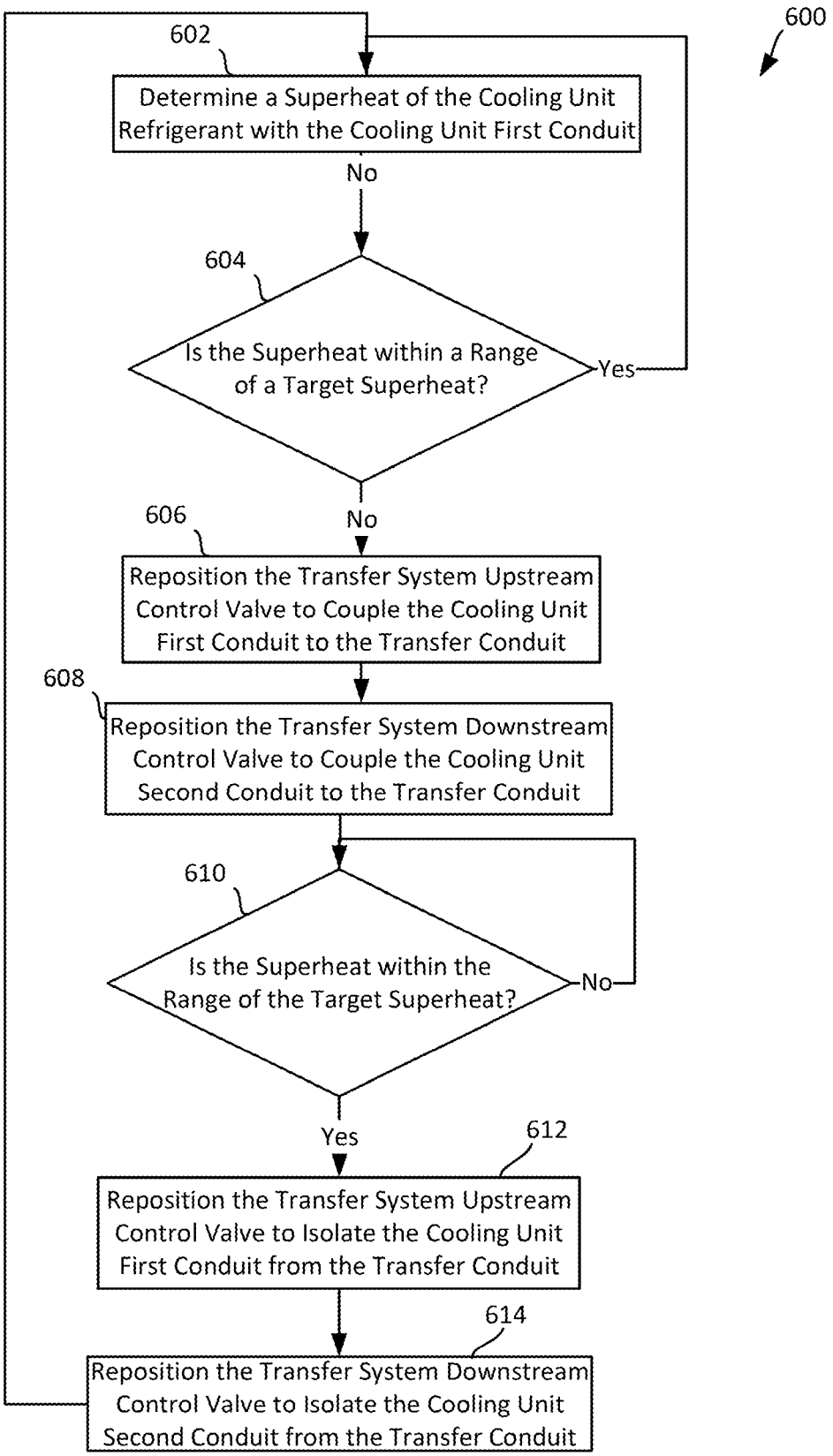
FIG. 6 is another block diagram of an example method of utilizing a transfer system of a cooling unit.

As shown in FIG. 6, a method 600 of utilizing the transfer system 442 to transfer the cooling unit refrigerant from upstream of the cooling unit pump 402 to downstream of the cooling unit pump 402.

The method 600 begins in block 602 with determining, by the cooling unit controller 422 (e.g., via the cooling unit sensor module 434, etc.), a superheat of the cooling unit refrigerant in the cooling unit first conduit 404. For example, the cooling unit controller 422 may utilize the refrigerant parameter measured by the cooling unit sensor 424 to determine the superheat.

The method 600 continues in block 604 with determining, by the cooling unit controller 422, if the superheat is within a range (e.g., 2%, 5%, 10%, etc.) of a target superheat. If the cooling unit controller 422 determines that the superheat is within the range of the target superheat, the method 600 restarts (e.g., ends and continues to block 602 again, etc.).

If the cooling unit controller 422 determines that the superheat is not within the range of the target superheat, the method 600 continues in block 606 with repositioning the transfer system upstream control valve 446 to couple the cooling unit first conduit 404, downstream of the transfer system upstream control valve 446, to the transfer conduit 444. The method 600 then continues in block 608 with repositioning the transfer system downstream control valve 447 to couple the cooling unit second conduit 406, upstream of the transfer system downstream control valve 447, to the transfer conduit 444. As a result, the cooling unit refrigerant is provided from downstream of the cooling unit pump 402 around the cooling unit pump 402 and upstream of the cooling unit pump 402, thereby bypassing the upstream receiver 408, the condenser 412, the downstream receiver 416, and the evaporator 420.

The method 600 continues in block 610 with determining, by the cooling unit controller 422 (e.g., via the cooling unit power module 436, etc.), if the superheat is within the range of the target superheat. If the cooling unit controller 422 determines that the superheat is not within the range of the target superheat, the method 600 continues back to block 610 again.

If the cooling unit controller 422 determines that the superheat is within the range of the target superheat, the method 600 continues in block 612 with repositioning the transfer system upstream control valve 446 to isolate the cooling unit first conduit 404 from the transfer conduit 444 (e.g., to couple the cooling unit first conduit 404 upstream of the transfer system upstream control valve 446 to the cooling unit first conduit 404 downstream of the transfer system upstream control valve 446). The method 600 then continues in block 614 with repositioning the transfer system downstream control valve 447 to isolate the cooling unit second conduit 406 from the transfer conduit 444 (e.g., to couple the cooling unit second conduit 406 upstream of the transfer system downstream control valve 447 to the cooling unit second conduit 406 downstream of the transfer system downstream control valve 447). The method 600 then restarts (e.g., ends and continues to block 602 again, etc.).

XI. Example Operation of the Expansion System

Figure 7:
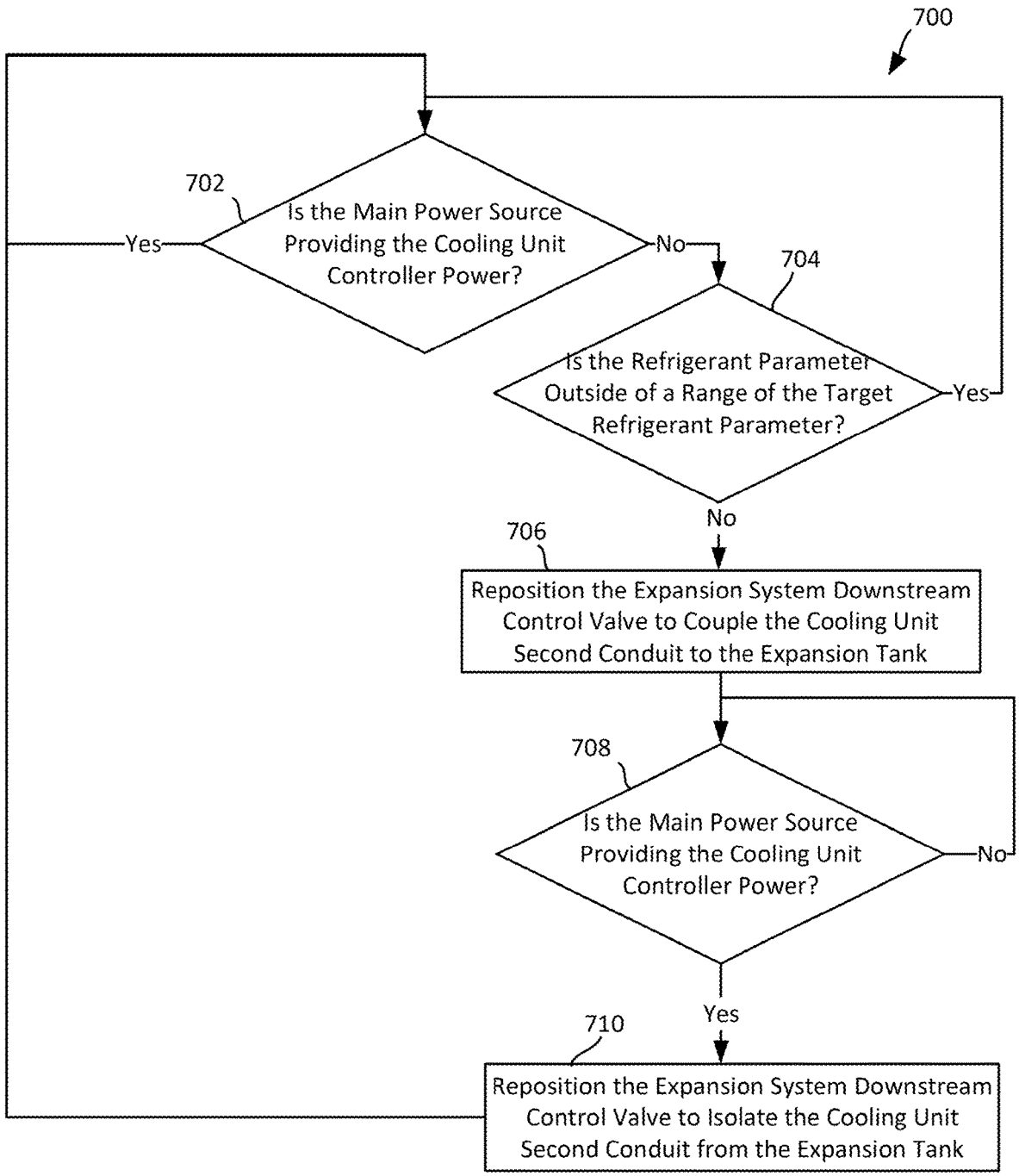
FIG. 7 is a block diagram of an example method of utilizing an expansion system of a cooling unit.

As shown in FIG. 7, a method 700 of utilizing the expansion system 450 to transfer the cooling unit refrigerant from upstream of the cooling unit pump 402 to the expansion tank 468.

The method 700 begins in block 702 with determining, by the cooling unit controller 422 (e.g., via the cooling unit power module 436, etc.), if the main power source 132 is providing the cooling unit controller 422 with power. For example, the cooling unit controller 422 may monitor a current and/or voltage provided by the main power source 132 and determine that the main power source 132 is not providing the cooling unit controller 422 power when the current and/or voltage drops below a threshold (e.g., a minimum current, a minimum voltage, etc.). If the cooling unit controller 422 determines that the main power source 132 is providing the cooling unit controller 422 with power, the method 700 restarts (e.g., ends and continues to block 702 again, etc.).

If the cooling unit controller 422 determines that the main power source 132 is not providing the cooling unit controller 422 with power, the method 700 continues in block 704 with determining, by the cooling unit controller 422, if the refrigerant parameter measured by the cooling unit sensor 424 is within a range (e.g., 2%, 5%, 10%, etc.) of a target refrigerant parameter. For example, the cooling unit controller 422 may determine that the pressure of the cooling unit refrigerant is outside of the range of the target pressure. If the cooling unit controller 422 determines that the refrigerant parameter is within the range of the target refrigerant parameter, the method 700 restarts (e.g., ends and continues to block 702 again, etc.).

If the cooling unit controller 422 determines that the refrigerant parameter is not within the range of the target refrigerant pressure, the method 700 continues in block 706 with repositioning the expansion system downstream control valve 464 to couple the cooling unit second conduit 406 to the expansion tank 468 (e.g., via the expansion system second conduit 454 and the expansion system third conduit 456). As a result, the cooling unit refrigerant is provided from downstream of the cooling unit pump 402 to the expansion tank 468.

The method 700 continues in block 708 with determining, by the cooling unit controller 422 (e.g., via the cooling unit power module 436, etc.), if the main power source 132 is providing the cooling unit controller 422 with power. For example, the cooling unit controller 422 may monitor a current and/or voltage provided by the main power source 132 and determine that the main power source 132 is providing the cooling unit controller 422 power when the current and/or voltage drops exceeds a threshold (e.g., a minimum current, a minimum voltage, etc.). If the cooling unit controller 422 determines that the main power source 132 is not providing the cooling unit controller 422 with power, the method 700 continues back to block 708 again.

If the cooling unit controller 422 determines that the main power source 132 is providing the cooling unit controller 422 with power, the method 700 continues in block 710 with repositioning the expansion system downstream control valve 464 to isolate the cooling unit second conduit 406 from the expansion tank 468. The method 700 then restarts (e.g., ends and continues to block 702 again, etc.).

XII. Example Operation of the Chilling System

Figure 8:
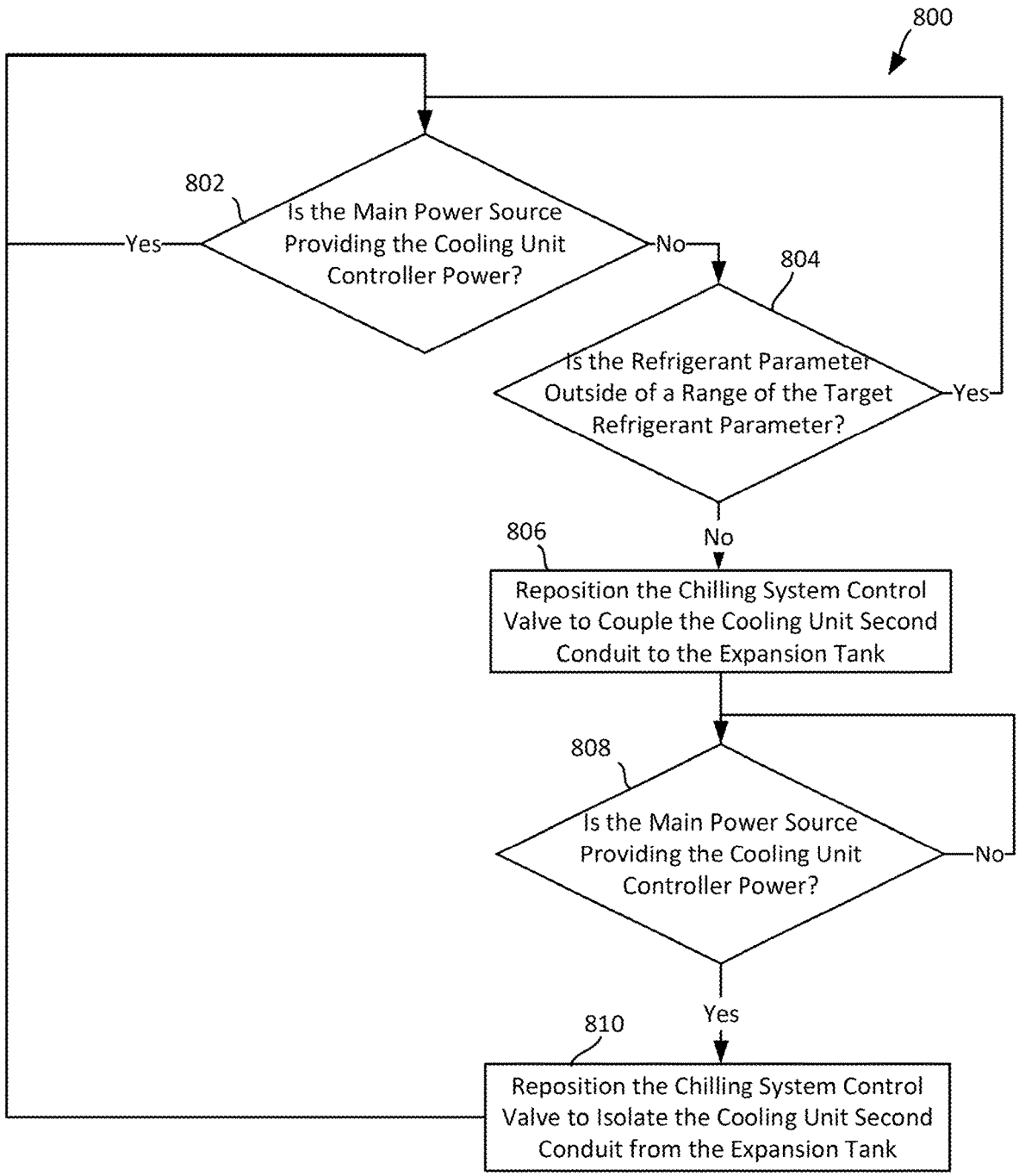
FIG. 8 is a block diagram of an example method of utilizing a chilling system of a cooling unit.

As shown in FIG. 8, a method 800 of utilizing the chilling system 472 to transfer the cooling unit refrigerant from upstream of the cooling unit pump 402 to the chilling tank 480.

The method 800 begins in block 802 with determining, by the cooling unit controller 422 (e.g., via the cooling unit power module 436, etc.), if the main power source 132 is providing the cooling unit controller 422 with power. For example, the cooling unit controller 422 may monitor a current and/or voltage provided by the main power source 132 and determine that the main power source 132 is not providing the cooling unit controller 422 power when the current and/or voltage drops below a threshold (e.g., a minimum current, a minimum voltage, etc.). If the cooling unit controller 422 determines that the main power source 132 is providing the cooling unit controller 422 with power, the method 800 restarts (e.g., ends and continues to block 802 again, etc.).

If the cooling unit controller 422 determines that the main power source 132 is not providing the cooling unit controller 422 with power, the method 800 continues in block 804 with determining, by the cooling unit controller 422, if the refrigerant parameter measured by the cooling unit sensor 424 is within a range (e.g., 2%, 5%, 10%, etc.) of a target refrigerant parameter. For example, the cooling unit controller 422 may determine that the pressure of the cooling unit refrigerant is outside of the range of the target pressure. If the cooling unit controller 422 determines that the refrigerant parameter is within the range of the target refrigerant parameter, the method 800 restarts (e.g., ends and continues to block 802 again, etc.).

If the cooling unit controller 422 determines that the refrigerant parameter is not within the range of the target refrigerant pressure, the method 800 continues in block 806 with repositioning the chilling system control valve 478 to couple the cooling unit second conduit 406 to the chilling tank 480 (e.g., via the chilling system first conduit 474). As a result, the cooling unit refrigerant is provided from downstream of the cooling unit pump 402 to the chilling tank 480.

The method 800 continues in block 808 with determining, by the cooling unit controller 422 (e.g., via the cooling unit power module 436, etc.), if the main power source 132 is providing the cooling unit controller 422 with power. For example, the cooling unit controller 422 may monitor a current and/or voltage provided by the main power source 132 and determine that the main power source 132 is providing the cooling unit controller 422 power when the current and/or voltage drops exceeds a threshold (e.g., a minimum current, a minimum voltage, etc.). If the cooling unit controller 422 determines that the main power source 132 is not providing the cooling unit controller 422 with power, the method 800 continues back to block 808 again.

If the cooling unit controller 422 determines that the main power source 132 is providing the cooling unit controller 422 with power, the method 800 continues in block 810 with repositioning the chilling system control valve 478 to isolate the cooling unit second conduit 406 from the chilling tank 480. The method 800 then restarts (e.g., ends and continues to block 802 again, etc.).

XIII. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the term "generally" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The terms "fluid communication with" and the like, as used herein, mean the two components or objects have a pathway formed between the two components or objects in which a fluid, such as air, liquid refrigerant, gaseous refrigerant, mixed-phase refrigerant, etc., may flow, either with or without intervening components or objects. Examples of configurations for enabling fluid communication may include piping, channels, or any other suitable components for enabling the flow of a fluid from one component or object to another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W to P, etc.) herein are inclusive of their maximum values and minimum values (e.g., W to P includes W and includes P, etc.), unless otherwise indicated. Furthermore, a range of values (e.g., W to P, etc.) does not necessarily require the inclusion of intermediate values within the range of values (e.g., W to P can include only W and P, etc.), unless otherwise indicated.

What is claimed is:

1. A cooling unit configured to circulate a cooling unit refrigerant, the cooling unit comprising:

an expansion system upstream control valve that comprises an expansion system upstream control valve vent that is configured to receive the cooling unit refrigerant;

a cooling unit pump configured to receive the cooling unit refrigerant from the expansion system upstream control valve, the cooling unit pump fluidly coupled to the expansion system upstream control valve vent to receive the cooling unit refrigerant from the expansion system upstream control valve vent;

an expansion system downstream control valve configured to receive the cooling unit refrigerant from the cooling unit pump;

an expansion tank coupled to and between the expansion system upstream control valve and the expansion system downstream control valve, the expansion tank fluidly coupled to the expansion system upstream control valve vent to provide the cooling unit refrigerant to the expansion system upstream control valve vent;

a condenser configured to receive the cooling unit refrigerant from the cooling unit pump;

an evaporator configured to receive the cooling unit refrigerant from the condenser and to provide the cooling unit refrigerant to the expansion system upstream control valve; and a cooling unit controller configured to perform operations comprising:

operating the expansion system upstream control valve and the expansion system downstream control valve to facilitate routing of the cooling unit refrigerant to and from the expansion tank; and repositioning the expansion system downstream control valve to couple the expansion tank to the expansion system upstream control valve vent while isolating the expansion tank from the cooling unit pump.

2. The cooling unit of claim 1, further comprising:

an upstream receiver configured to receive the cooling unit refrigerant from the cooling unit pump and to provide the cooling unit refrigerant to the condenser;

a downstream receiver configured to receive the cooling unit refrigerant from the condenser and to provide the cooling unit refrigerant to the evaporator; and a cooling unit low pressure relief valve positioned between the evaporator and the cooling unit pump, the cooling unit low pressure relief valve configured to open when a pressure of the cooling unit refrigerant exceeds a low pressure threshold.

3. The cooling unit of claim 2, further comprising:

a transfer system upstream control valve configured to receive the cooling unit refrigerant from the evaporator;

a transfer system downstream control valve configured to provide the cooling unit refrigerant to the upstream receiver; and a transfer system conduit coupled to the transfer system upstream control valve and the transfer system downstream control valve and configured to facilitate bypassing of the upstream receiver, the condenser, the downstream receiver, and the evaporator.

4. The cooling unit of claim 2, wherein operating the expansion system upstream control valve and the expansion system downstream control valve to facilitate routing of the cooling unit refrigerant to and from the expansion tank comprises repositioning the expansion system downstream control valve to facilitate routing of the cooling unit refrigerant from the expansion system downstream control valve to the expansion tank while bypassing the condenser and the evaporator.

5. The cooling unit of claim 3, wherein:

the expansion system upstream control valve is further configured to receive the cooling unit refrigerant from the cooling unit pump and provide the cooling unit refrigerant to the expansion tank, the expansion system upstream control valve operable between an expansion system upstream control valve first position and an expansion system upstream control valve second position, the expansion system upstream control valve isolating the expansion tank from the upstream receiver in the expansion system upstream control valve first position and coupling the expansion tank and the upstream receiver downstream of the cooling unit pump in the expansion system upstream control valve second position; and the expansion system downstream control valve is further configured to receive the cooling unit refrigerant from the expansion tank and provide the cooling unit refrigerant to the cooling unit pump, the expansion system downstream control valve operable between a expansion system downstream control valve first position and an expansion system downstream control valve second position, the expansion system downstream control valve isolating the expansion tank from the evaporator in the expansion system upstream control valve first position and coupling the expansion tank and the evaporator upstream of the cooling unit pump in the expansion system downstream control valve second position.

6. The cooling unit of claim 5, further comprising a sensor configured to obtain a refrigerant parameter of the cooling unit refrigerant, wherein the cooling unit controller is communicable with the expansion system upstream control valve and the sensor, the cooling unit controller further configured to perform operations comprising:

receiving the refrigerant parameter from the sensor;

comparing the refrigerant parameter to a target refrigerant parameter; and based on a result of the comparison, operating the expansion system upstream control valve, the expansion system downstream control valve, the transfer system upstream control valve, and the transfer system downstream control valve to control the refrigerant parameter of the cooling unit refrigerant.

7. The cooling unit of claim 6, wherein operating the expansion system upstream control valve to control the refrigerant parameter of the cooling unit refrigerant based on a result of the comparison, comprises repositioning the expansion system upstream control valve from the expansion system upstream control valve first position to the expansion system upstream control valve second position in response to detecting that the refrigerant parameter is not within a range of the target refrigerant parameter.

8. The cooling unit of claim 7, wherein the refrigerant parameter is a pressure of the refrigerant and the range of the target refrigerant parameter is a range of the target refrigerant pressure.

9. The cooling unit of claim 8, wherein the cooling unit controller is further configured to, based on the result of the comparison indicating the pressure of the refrigerant exceeds the range of the target refrigerant pressure, perform operations comprising:

operating one or more of the expansion system upstream control valve, the expansion system downstream control valve, the transfer system upstream control valve, and the transfer system downstream control valve to control the refrigerant parameter of the cooling unit refrigerant to decrease a pressure of the cooling unit refrigerant upstream of the cooling unit pump.

10. The cooling unit of claim 1, wherein the cooling unit controller is further configured to perform operations comprising repositioning the expansion system downstream control valve to couple the cooling unit pump to the expansion system upstream control valve vent while isolating the expansion tank from the cooling unit pump.

11. The cooling unit of claim 1, wherein:

the expansion system downstream control valve further comprises an expansion system downstream control valve vent, the expansion system downstream control valve configured to receive the cooling unit refrigerant from the cooling unit pump or the expansion tank and provide the cooling unit refrigerant to the expansion system upstream control valve vent; and the cooling unit controller is further configured to perform operations comprising repositioning the expansion system upstream control valve to couple the expansion tank to the expansion system downstream control valve vent while isolating the expansion tank from the cooling unit pump.

12. The cooling unit of claim 11, wherein the cooling unit controller is further configured to perform operations comprising repositioning the expansion system downstream control valve to couple the cooling unit pump to the expansion system downstream control valve vent while isolating the expansion tank from the cooling unit pump.

13. The cooling unit of claim 5, wherein the cooling unit controller further comprises a timer, the cooling unit controller is further configured to perform operations comprising:

initiating the timer in response to a loss of power event to the cooling unit;

comparing a time of the timer to a time threshold; and based on the time exceeding the time threshold, repositioning one or more of the expansion system upstream control valve and the expansion system downstream control valve.

14. The cooling unit of claim 13, wherein repositioning one or more of the expansion system upstream control valve and the expansion system downstream control valve based on the time from the loss of power event to the cooling unit exceeding the time threshold comprises:

transitioning the expansion system upstream control valve from the second position to the first position; and transitioning the expansion system downstream control valve from the first position to the second position, providing the cooling unit refrigerant downstream of the cooling unit pump to the expansion tank, providing an increased volume for the cooling unit refrigerant upstream of the cooling unit pump, thereby decreasing pressure of the cooling unit refrigerant downstream of the cooling unit pump.

15. The cooling unit of claim 14, wherein the cooling unit controller is further configured to perform operations comprising, in response to a restoration of power event to the cooling unit, resetting the timer.

16. The cooling unit of claim 14, wherein the cooling unit controller is further configured to perform operations comprising:

in response to a restoration of power event to the cooling unit, transitioning the expansion system upstream control valve from the first position to the second position; and transitioning the expansion system downstream control valve from the second position to the first position, providing cooling unit refrigerant from the expansion tank to upstream of the cooling unit pump.

17. The cooling unit of claim 1, further comprising a cooling unit high pressure relief valve positioned downstream from the cooling unit pump between the cooling unit pump and the condenser, the cooling unit high pressure relief valve configured to open when the pressure of the cooling unit refrigerant within exceeds a high pressure threshold.

18. The cooling unit of claim 1, wherein the expansion tank comprises a replaceable expansion tank having two female couplings sized to receive two male couplings on conduits fluidically coupling the expansion tank to the expansion system upstream control valve and the expansion system downstream control valve.

19. The cooling unit of claim 11, wherein the cooling unit controller is further configured to perform operations to purge air within the expansion system, the operations comprising repositioning one or both of the expansion system upstream control valve and the expansion system downstream control valve from the first positions isolating the expansion tank to align the expansion tank to one or both of expansion system upstream control valve vent and the expansion system downstream control valve vent such that pressurized refrigerant within the expansion tank purges air from the expansion tank via one or both of the expansion system upstream control valve vent and the expansion system downstream control valve vent.

20. The cooling unit of claim 3, wherein the cooling unit controller is further configured to perform operations comprising:

responsive to a refrigerant parameter of the cooling unit refrigerant being outside a target threshold range, repositioning one or both of the transfer system upstream control valve and the transfer system downstream control valve; and responsive repositioning one or both of the transfer system upstream control valve and the transfer system downstream control valve, flowing the cooling unit refrigerant from the expansion tank to a location upstream of the cooling unit pump or to a location downstream of the cooling unit pump, respectively.

21. The cooling unit of claim 20, wherein the refrigerant parameter is a pressure of the cooling unit refrigerant and the target threshold range is a target pressure range.

22. A cooling unit configured to circulate a cooling unit refrigerant, the cooling unit comprising:

an expansion system upstream control valve;

a cooling unit pump configured to receive the cooling unit refrigerant from the expansion system upstream control valve;

an expansion system downstream control valve configured to receive the cooling unit refrigerant from the cooling unit pump;

an expansion tank coupled to and between the expansion system upstream control valve and the expansion system downstream control valve;

a condenser configured to receive the cooling unit refrigerant from the cooling unit pump;

an evaporator configured to receive the cooling unit refrigerant from the condenser and to provide the cooling unit refrigerant to the expansion system upstream control valve;

a cooling unit controller configured to perform operations comprising operating the expansion system upstream control valve and the expansion system downstream control valve to facilitate routing of the cooling unit refrigerant to and from the expansion tank;

an upstream receiver configured to receive the cooling unit refrigerant from the cooling unit pump and to provide the cooling unit refrigerant to the condenser;

a downstream receiver configured to receive the cooling unit refrigerant from the condenser and to provide the cooling unit refrigerant to the evaporator; and a cooling unit low pressure relief valve positioned between the evaporator and the cooling unit pump, the cooling unit low pressure relief valve configured to open when a pressure of the cooling unit refrigerant exceeds a low pressure threshold.

23. The cooling unit of claim 22, further comprising:

a transfer system upstream control valve configured to receive the cooling unit refrigerant from the evaporator;

a transfer system downstream control valve configured to provide the cooling unit refrigerant to the upstream receiver; and a transfer system conduit coupled to the transfer system upstream control valve and the transfer system downstream control valve, the transfer system conduit configured to conduct the coolant unit refrigerant from the transfer system upstream control valve and the transfer system downstream control valve bypassing the upstream receiver, the condenser, the downstream receiver, and the evaporator.

24. The cooling unit of claim 22, wherein operating the expansion system upstream control valve and the expansion system downstream control valve to facilitate routing of the cooling unit refrigerant to and from the expansion tank comprises repositioning the expansion system downstream control valve to route the cooling unit refrigerant from the expansion system downstream control valve to the expansion tank while bypassing the condenser and the evaporator.

25. The cooling unit of claim 24, wherein:

the expansion system upstream control valve is further configured to receive the cooling unit refrigerant from the cooling unit pump and provide the cooling unit refrigerant to the expansion tank, the expansion system upstream control valve operable between an expansion system upstream control valve first position and an expansion system upstream control valve second position, the expansion system upstream control valve isolating the expansion tank from the upstream receiver in the expansion system upstream control valve first position and coupling the expansion tank and the upstream receiver downstream of the cooling unit pump in the expansion system upstream control valve second position; and the expansion system downstream control valve is further configured to receive the cooling unit refrigerant from the expansion tank and provide the cooling unit refrigerant to the cooling unit pump, the expansion system downstream control valve operable between a expansion system downstream control valve first position and an expansion system downstream control valve second position, the expansion system downstream control valve isolating the expansion tank from the evaporator in the expansion system upstream control valve first position and coupling the expansion tank and the evaporator upstream of the cooling unit pump in the expansion system downstream control valve second position.

26. The cooling unit of claim 25, further comprising a sensor configured to obtain a refrigerant parameter of the cooling unit refrigerant, wherein the cooling unit controller is communicable with the expansion system upstream control valve and the sensor, the cooling unit controller further configured to perform operations comprising:

receiving the refrigerant parameter from the sensor;

comparing the refrigerant parameter to a target refrigerant parameter; and based on a result of the comparison indicating that the refrigerant parameter is not within a target range of the target refrigerant parameter, repositioning the expansion system upstream control valve from the expansion system upstream control valve first position to the expansion system upstream control valve second position.

27. The cooling unit of claim 26, wherein the refrigerant parameter is a pressure of the refrigerant and the range of the target refrigerant parameter is a target range of the refrigerant pressure.

28. The cooling unit of claim 27, wherein the cooling unit controller is further configured to, based on the result of the comparison indicating the pressure of the refrigerant exceeds the target range of the refrigerant pressure, operating one or more of the expansion system upstream control valve, the expansion system downstream control valve, the transfer system upstream control valve, and the transfer system downstream control valve to control the refrigerant pressure to decrease a pressure of the cooling unit refrigerant upstream of the cooling unit pump.

29. The cooling unit of claim 22, wherein the cooling unit controller is further configured to perform operations comprising repositioning the expansion system downstream control valve to couple the cooling unit pump to the expansion system upstream control valve vent while isolating the expansion tank from the cooling unit pump.

30. The cooling unit of claim 22, further comprising an expansion system downstream control valve vent coupled to the expansion system downstream control valve, the expansion system downstream control valve configured to receive the cooling unit refrigerant from the cooling unit pump or the expansion tank and provide the cooling unit refrigerant to the expansion system upstream control valve vent; and the cooling unit controller is further configured to perform operations comprising repositioning the expansion system upstream control valve to couple the expansion tank to the expansion system downstream control valve vent while isolating the expansion tank from the cooling unit pump and repositioning the expansion system downstream control valve to couple the cooling unit pump to the expansion system downstream control valve vent while isolating the expansion tank from the cooling unit pump.

31. The cooling unit of claim 22, wherein the cooling unit controller further comprises a timer, the cooling unit controller is further configured to perform operations comprising:

initiating the timer in response to a loss of power event to the cooling unit;

comparing a time of the timer to a time threshold;

based on the time exceeding the time threshold, repositioning one or both of the expansion system upstream control valve and the expansion system downstream control valve; and based on one or both of the expansion system upstream control valve and the expansion system downstream control valve, providing the cooling unit refrigerant downstream of the cooling unit pump to the expansion tank, thereby decreasing pressure of the cooling unit refrigerant downstream of the cooling unit pump.

32. The cooling unit of claim 31, wherein the cooling unit controller is further configured to perform operations comprising:

in response to a restoration of power event to the cooling unit, resetting the timer;

transitioning the expansion system upstream control valve from the first position to the second position; and transitioning the expansion system downstream control valve from the second position to the first position, providing cooling unit refrigerant from the expansion tank to upstream of the cooling unit pump.

33. The cooling unit of claim 22, wherein the cooling unit controller is further configured to perform operations to purge air within the expansion system, the operations comprising repositioning one or both of the expansion system upstream control valve and the expansion system downstream control valve from the first positions isolating the expansion tank to align the expansion tank to one or both of expansion system upstream control valve vent and the expansion system downstream control valve vent such that pressurized refrigerant within the expansion tank purges air from the expansion tank via one or both of the expansion system upstream control valve vent and the expansion system downstream control valve vent.

34. The cooling unit of claim 22, wherein the cooling unit controller is further configured to perform operations comprising:

responsive to a refrigerant parameter of the cooling unit refrigerant being outside a target threshold range, repositioning one or both of the transfer system upstream control valve and the transfer system downstream control valve; and responsive repositioning one or both of the transfer system upstream control valve and the transfer system downstream control valve, flowing the cooling unit refrigerant from the expansion tank to a location upstream of the cooling unit pump or to a location downstream of the cooling unit pump, respectively.

* * * * *